US009158270B2

(12) United States Patent
Nanno

(10) Patent No.: US 9,158,270 B2
(45) Date of Patent: Oct. 13, 2015

(54) FIXING DEVICE, IMAGE FORMING APPARATUS WITH SAME, AND METHOD OF SMOOTHLY DETACHING AND ATTACHING FIXING DEVICE FROM AND TO IMAGE FORMING APPARATUS

(71) Applicant: Shigeo Nanno, Kyoto (JP)

(72) Inventor: Shigeo Nanno, Kyoto (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/082,254

(22) Filed: Nov. 18, 2013

(65) Prior Publication Data

US 2014/0153965 A1 Jun. 5, 2014

(30) Foreign Application Priority Data

Dec. 5, 2012 (JP) ..... 2012-266336

(51) Int. Cl.
*G03G 15/20* (2006.01)
*G03G 21/16* (2006.01)

(52) U.S. Cl.
CPC ..... *G03G 21/1685* (2013.01); *G03G 21/1647* (2013.01); *G03G 2221/1639* (2013.01)

(58) Field of Classification Search
CPC ..... G03G 21/1685; G03G 2221/1639; G03G 21/1647
USPC ..... 399/122, 320, 328; 219/216
See application file for complete search history.

(56) References Cited

U.S. PATENT DOCUMENTS

| | | | | |
|---|---|---|---|---|
| 6,697,589 | B1 * | 2/2004 | Dunning et al. | 399/122 |
| 2008/0219700 | A1 * | 9/2008 | Saiki et al. | 399/122 |
| 2009/0010680 | A1 | 1/2009 | Nanno | |
| 2009/0074440 | A1 | 3/2009 | Nanno et al. | |
| 2013/0004203 | A1 * | 1/2013 | Ohnishi | 399/122 |

FOREIGN PATENT DOCUMENTS

| | | |
|---|---|---|
| JP | 8-305205 | 11/1996 |
| JP | 2003-241615 | 8/2003 |
| JP | 2006-162997 | 6/2006 |
| JP | 2009-015002 | 1/2009 |

OTHER PUBLICATIONS

U.S. Appl. No. 14/017,383, filed Sep. 4, 2013.

* cited by examiner

*Primary Examiner* — Robert Beatty
(74) *Attorney, Agent, or Firm* — Harness, Dickey & Pierce, P.L.C.

(57) ABSTRACT

A fixing device includes a housing detachably attached to a body of an image forming apparatus, a fixing unit mounted on the housing to heat and fix an unfixed toner image onto a recording medium, a locking mechanism to lock and unlock the housing in the body of the image forming apparatus by switching its own position from a locking position to an unlocking position, vice-versa, and an operating member integrally connected to the locking mechanism to operate the locking mechanism. First and second handling members are provided on lower and upper sides of the housing, respectively, to be handled when the housing is either attached to or detached from the body of the image forming apparatus. The operating member approaches the second handling member when the locking mechanism changes its position to detach the housing from the body of the image forming apparatus.

20 Claims, 15 Drawing Sheets

FIXING DEVICE, IMAGE FORMING APPARATUS WITH SAME, AND METHOD OF SMOOTHLY DETACHING AND ATTACHING FIXING DEVICE FROM AND TO IMAGE FORMING APPARATUS

CROSS-REFERENCE TO RELATED APPLICATION

This patent application is based on and claims priority pursuant to 35 U.S.C. §119 to Japanese Patent Application No. 2012-266336, filed on Dec. 5, 2012 in the Japan Patent Office, the entire disclosure of which is hereby incorporated by reference herein.

BACKGROUND

1. Technical Field

This invention relates to a fixing device and an image forming apparatus equipped with the same to fix an unfixed toner image onto a recording medium.

2. Related Art

In general, a fixing device used in an image forming apparatus, such as a copier, a facsimile machine, a printer, etc., is detachably attachable to a body of the image forming apparatus to facilitate replacement and repair.

For example, such a detachably attachable conventional fixing device includes a body, a fixing unit accommodated in the body while including a fixing roller and a pressure roller therein, and a handle provided in an upper section in the body. In an image forming apparatus with such a detachably attachable fixing device, by opening a body cover attached to the image forming apparatus and vertically lifting the handle, the fixing device is removable from the body of the image forming apparatus. Conversely, the fixing device is attachable to the body of the image forming apparatus by holding the handle.

Another known fixing device includes a fixing unit and a handle at a lateral end of the fixing unit (i.e., a direction perpendicular to a conveyance direction of a recording medium) and is detachably attached to the body of the image forming apparatus. In such a fixing device, when the handle is pivoted and set in a conveying direction of the recording medium, the fixing device is locked in the body of the image forming apparatus. Conversely, when the handle is pivoted and set in the above-described widthwise direction, the fixing device is unlocked from the body of the image forming apparatus. Thus, when an operator vertically lifts the handle in such an unlocked state, the fixing device is removable from the body of the image forming apparatus. By contrast, the fixing device can be housed in the body of the image forming apparatus and is locked therein when an operator swings the handle to set the handle in a direction in which the recording medium is conveyed.

Yet another conventionally known fixing device includes a housing accommodating a heating roller, a fixing roller, a pressure roller, and a fixing belt. The fixing device further includes a locking mechanism to lock and unlock the housing in a body of the image forming apparatus and a switching lever to switch a locking condition to an unlocking condition vice-versa. The fixing device also includes an operating section to swing the switching lever and a holding section at a bottom of the housing. The fixing device can be detachably attached to a body of the image forming apparatus. Thus, the fixing device is removable from the body of the image forming apparatus by manipulating the switching lever and bringing the locking mechanism in an unlocking state, while horizontally drawing the housing by holding the operation and holding sections. Conversely, the fixing device is set to the body of the image forming apparatus by horizontally pressing the housing toward the body of the image forming apparatus while holding the operation and holding sections and manipulating the switching lever bringing the locking mechanism in the locking state.

Further, yet another known fixing device includes a fixing frame that accommodates a heating roller and a pressure roller therein, a ceiling plate covering the fixing frame, a fixing cover, a locking mechanism, a handle, and a releasing lever to unblock the locking mechanism. In the conventional fixing device, the handle and the releasing lever collectively function as an operating section to remove the fixing device from the body of the image forming apparatus. Specifically, the fixing device is removable from the body of the image forming apparatus by holding and withdrawing the handle and the releasing lever while cancelling the locking state of the locking mechanism. Conversely, by inserting the fixing device into the body of the image forming apparatus while holding the handle and the releasing lever, the fixing device can be set while bringing the locking mechanism in the locking state.

SUMMARY

Accordingly, one aspect of the present invention provides a novel fixing device that includes a housing detachably attachable to a body of an image forming apparatus; a fixing unit mounted on the housing to heat and fix an unfixed toner image onto a recording medium; and a locking mechanism to lock and unlock the housing on the body of an image forming apparatus by switching its own position between a locking position and an unlocking position. An operating member is provided in the housing to operate the locking mechanism. A first handling member is provided at a lower side in the housing to be handled when the housing is either attached to or detached from the body of an image forming apparatus. A second handling member is provided at an upper side in the housing in the vicinity of the operating member to be handled when the housing is either attached to or detached from the body of an image forming apparatus. The operating member and the first and second handling members collectively constituting a handling unit to be simultaneously handled when the housing is either detached from or attached to the body of the image forming apparatus.

Another aspect of the present invention provides a novel image forming apparatus that includes the above-described fixing device.

Yet another aspect of the present invention provides a novel method of accommodating and removing the above-described fixing device that heats and fixes an unfixed toner image onto a recording medium to and from an image forming apparatus. The method comprising the steps of: grasping the first handling member with a first finger; grasping the operating member with a second finger other than the first finger; pivoting the locking mechanism with the second finger via the operating member from locking to unlocking positions; grasping the operating member and the second handling member at the same time with the second finger when the locking mechanism is pivoted and the operating member approaches the second handling member; and detaching the housing from the body of the image forming apparatus while grasping both the first and second handling members with the first and second fingers simultaneously.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
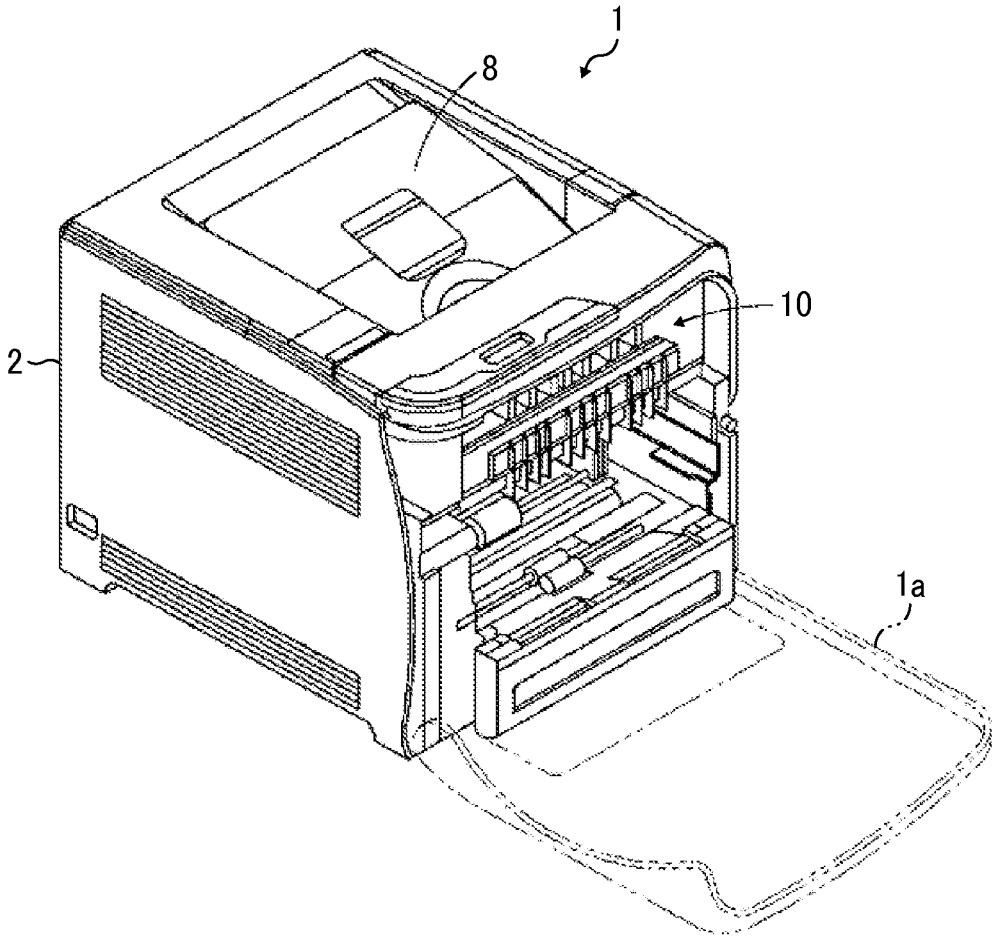
FIG. 1 is a schematic perspective view illustrating a color image forming apparatus accommodating a fixing device according to one embodiment of the present invention.

Referring now to the drawings, wherein like reference numerals designate identical or corresponding section throughout the several views thereof and in particular to FIG. 1, exemplary embodiments of a color image forming apparatus, to which the present invention of an image formation apparatus with a fixing device is applied are described.

Figure 2:
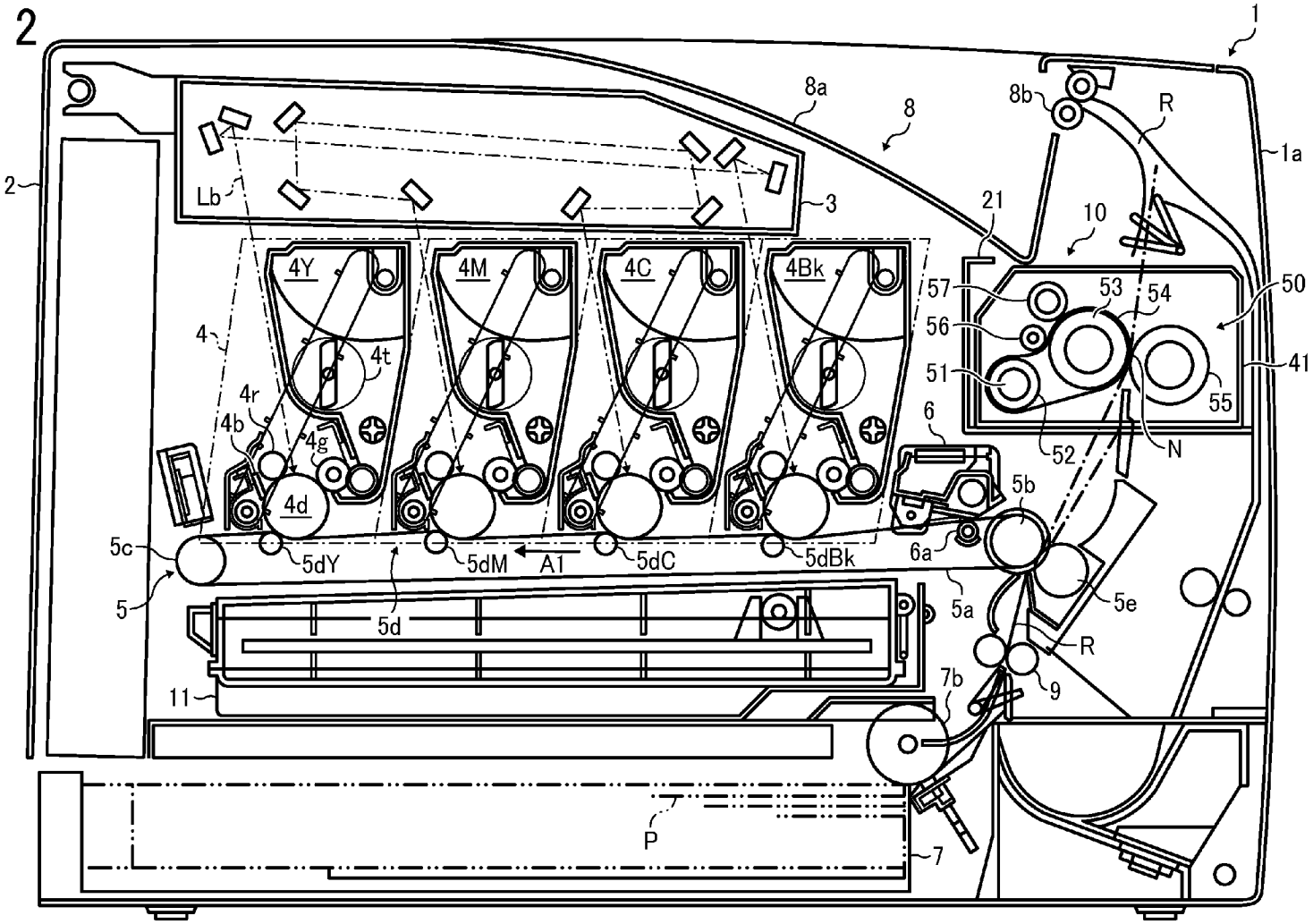
FIG. 2 is a perspective view illustrating the color image forming apparatus accommodating the fixing device according to one embodiment of the present invention.

As shown in FIGS. 1 and 2, a color image forming apparatus 1 according to this embodiment includes an apparatus body 2, an exposing unit 3, a process unit 4, a transfer belt unit 5, a belt cleaning unit 6, a sheet cassette 7, a sheet ejection tray 8, a registration roller 9, and a fixing device 10. The color image forming apparatus 1 further includes a front cover 1*a* that opens the apparatus body 2 and a waste toner container 11 as well. When the front cover 1*a* opens as shown in FIG. 1, and various components, such as a fixing device 10, etc., are exposed to be ready to remove the components such as the fixing device 10, etc.

The color image forming apparatus 1 is configured by a tandem structure, in which more than one photoconductive drum composed of image carriers is disposed side by side to form images of component colors separated to yellow (Y), cyan (C), magenta (M), and black (Bk), respectively. Please note, the image forming apparatus related to one embodiment of this invention is not limited to the tandem structure, and can employ the other type structure than that. Further, the image forming apparatus related to one embodiment of this invention is not limited to the color image forming apparatus 1 as well, and can employ the other image forming device than that, such as a copying machine, a facsimile machine, etc.

The apparatus body 2 is configured by a housing that accommodates multiple components including a holding frame 21 that holds the fixing device 10. A transporting path R is also provided in the housing of the apparatus body 2 to carry a recording sheet P as a recording medium accommodated in the sheet-feeding cassette 7. Here, a direction in which the fixing device 10 is detached toward a front side from the holding frame 21 corresponds to a direction as shown by arrow A, and a direction toward the backside opposed to that of arrow A corresponds to that of arrow B. These arrows A and B are displayed in the drawings upon need herein below.

Figure 3:
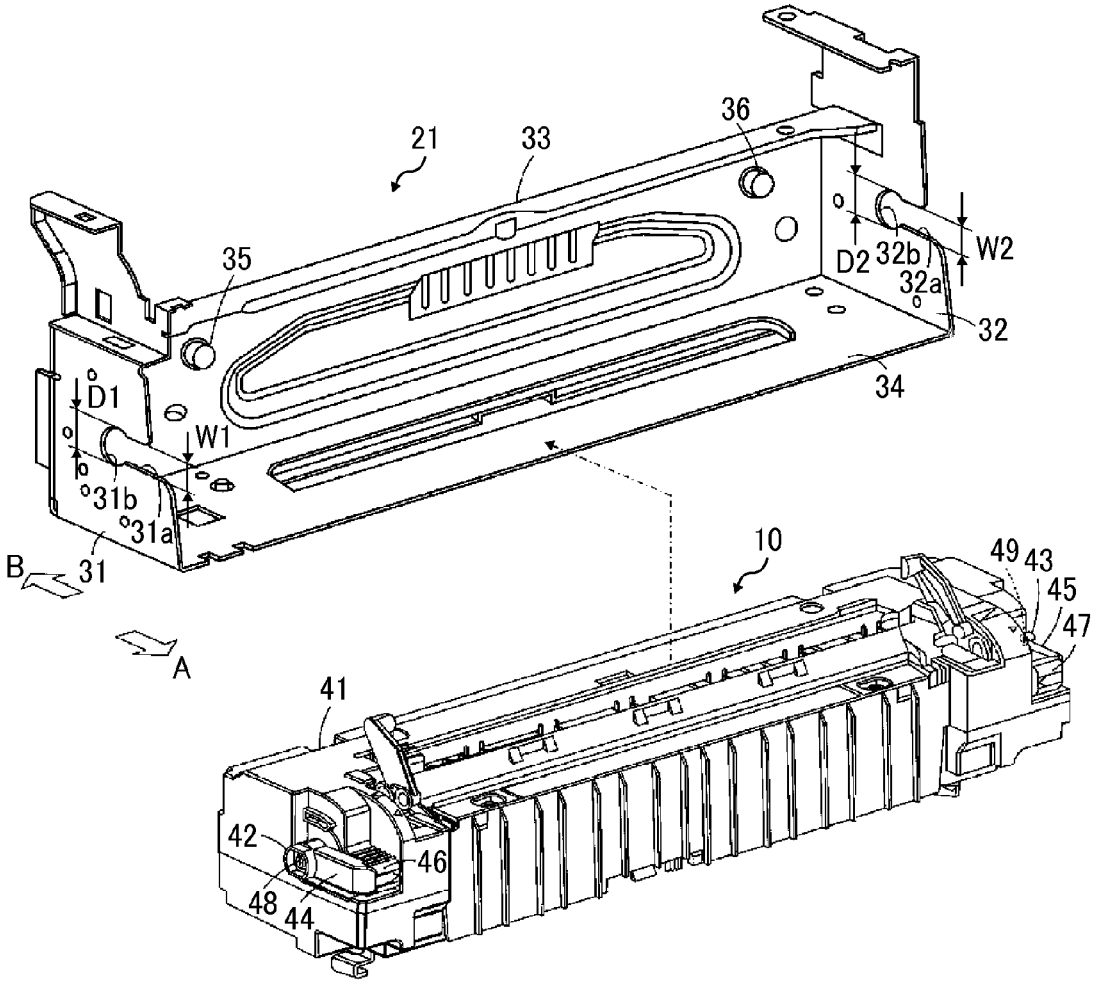
FIG. 3 is a perspective view illustrating an aspect when the fixing device has been removed from a holding frame provided in the color image forming apparatus that accommodates the fixing device according to one embodiment of the present invention.

Further, as shown in FIG. 3, the holding frame 21 is composed of a housing having an opening at the front side in the direction as shown by arrow A. When viewed from the front side, the holding frame 21 of the housing includes a left side plate 31 provided on the left side and a right side plate 32 provided on the right side thereof, a backside board 33, and a bottom plate 34 each connecting the left side plate 31 and the right side plate 31, and a pair of positioning pins 35 and 36. The left side plate 31, the right side plate 32, the backboard 33, and the bottom plate 34 are formed integrally with each other to collectively constitute the holding frame 21.

Figure 4:
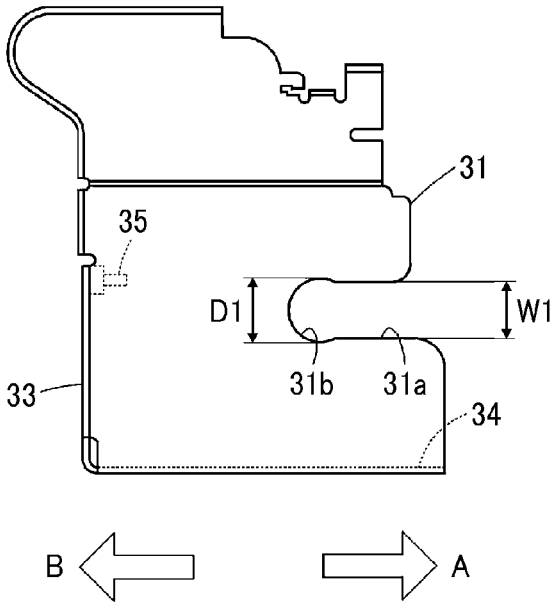
FIG. 4 is a side view illustrating a left side plate of the holding frame provided in the color image forming apparatus that accommodates the fixing device according to one embodiment of the present invention.
Figure 5:
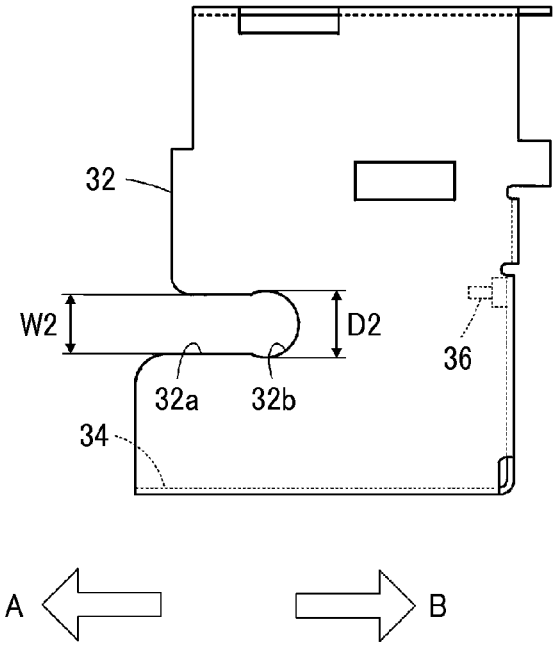
FIG. 5 is a side view illustrating a right side plate of the holding frame provided in the color image forming apparatus that accommodates the fixing device according to one embodiment of the present invention.

Further, as shown in FIG. 4, the left side plate 31 includes an opening in the front side in the direction as shown by arrow A having a slit 31*a* with a width W1 and a through-hole 31*b* with a diameter D1. An end of the slit 31*a* in the direction as shown by arrow B and the through hole 31*b* are communicated with each other. Further, as shown in FIG. 5, similar to the left side plate 31, the right side plate 32 also includes an opening in the front side in the direction as shown by arrow A having a slit 32*a* as with a width W2 and a through-hole 32*b* with a diameter D2 as well. An end of the slit 32*a* in the direction as shown by arrow B and the through hole 32*b* are communicated with each other similarly.

Although the width W1 of the left side plate 31 and that of W2 of the right side plate 32 have substantially the same dimension with each other, those widths may be differentiated from each other. Further, although the diameter D1 of the through hole 32*b* of the left side plate 31 and that of D2 of the right side plate 32 have substantially the same dimension with each other, those diameters may also be differentiated from each other. These slits 31*a* and 32*a* respectively swerve as guides to guide the fixing device 10 when it is detached and attached from and to the holding frame 21.

The positioning pin 35 is attached to the backboard 33 provided near the left side plate 31 while projecting in the direction as shown by arrow A. Similar to the positioning pin 35, the positioning pin 36 is attached to the backboard 33 provided near the right side plate 32 while projecting in the direction as shown by arrow A. The positioning pins 35 and 36 are provided to determine a position of the fixing device 10 when it is held in the holding frame 21.

The bottom plate 34 includes a flat horizontal surface extended perpendicular to a vertical direction when the fixing device 10 is held by the holding frame 21. The bottom plate 34 acts as a receiving section supporting the fixing device 10 when the fixing device 10 is attached or detached to and from the holding frame 21. Specifically, the bottom plate 34 constitutes a device receiving section receiving a bottom of the fixing device 10 according to one embodiment of the present invention.

Further, the exposing unit 3 is configured by a semiconductor laser, not shown, as a light source, a coupling lens, an f-theta lens, a toroidal lens, a returning mirror, and a rotating polygonal mirror. The exposing unit 3 is configured to emit a writing light LB (Laser Beam) to a process unit 4 to form an electrostatic latent image corresponding to a component color. Image information included in the exposed laser light includes monochromatic image information obtained by decomposing a prescribed full-color image into respective component colors of yellow, cyan, magenta, and black.

The process unit 4 includes sub-process units 4Y, 4C, 4M, and 4Bk to be attached and detached to and from the apparatus body 2. The process unit 4Y includes a toner supply unit 4*t*, a photoconductive drum 4*d*, a charging roller 4*r*, a developing device 4*g*, and a cleaning blade 4*b*. The process unit 4Y is configured to execute charging, exposing, developing, transferring, cleaning, and charge-eliminating processes one by one.

In this process unit 4Y, the charging roller 4*r* initially provides the photoconductive drum 4*d* with electric charge so that static electricity can be stored therein. To the charged surface of the photoconductive drum 4*d*, the exposing unit 3 applies an exposing process, so that the photoconductive drum 4*d* bears an electrostatic latent image composed of electrostatic patterns. Further, yellow toner bonds to the electrostatic latent image borne on the photoconductive drum 4*d*, i.e., development is executed, and accordingly the developing device 4*g* forms a toner image. The toner image is then transferred onto the transfer belt unit 5. As a preparation for the next transfer process, a cleaning blade 4*b* then removes toner remaining on the photoconductive drum 4*d* therefrom. Static electricity remaining on the photoconductive drum 4*d* is also removed for the same purpose as well.

The photoconductor drum 4*d* includes a photoconductive layer composed of an inorganic or organic photoconductor on a cylindrical surface. The charging roller 4*r* is placed near the photoconductive drum 4*d* and generates electric discharge in a gap formed between the photoconductive drum 4*d* and itself to discharge the photoconductive drum 4*d*. The developing device 4*g* is configured by a toner supplying section to supply yellow toner and a developer section to stick the yellow toner onto the photoconductive drum 4*d*. The cleaning blade 4*b* includes a resilient plate member made of such as rubber, etc., and a toner removal section such as a brush, etc., as well. The developing device 4*g* is removably accommodated in the apparatus body 2.

Further, each of the process units 4C, 4M, and 4Bk is similarly configured as the process unit 4Y as well. These process units 4C, 4M, and 4Bk transfer a cyan toner image, a magenta toner image, and a black toner image onto a transfer belt unit 5, respectively.

The transfer belt unit 5 includes a transfer belt 5*a*, a driving roller 5*b*, a driven roller 5*c*, a primary transfer roller 5*d*, and a secondary transfer roller 5*e*. The transfer belt 5*a* is configured from a so-called endless belt omitting a terminal of the belt, and is suspended by a driving roller 5*b* and a driven roller 5*c* therebetween while generating a prescribed tension therein. The transfer belt 5*a* is rotated to circulate and run by the driving roller 5*b* and the driven roller 5*c* in a direction as shown by arrow A1 in the drawing.

The primary transfer roller group 5*d* includes multiple primary transfer rollers 5*d*Y, 5*d*C, 5*d*M, and 5*d*Bk pressing against the photoconductive drums 4*d* of the process units 4Y, 4C, 4M, and 4Bk through the transfer belt 5*a*, respectively. Thus, multiple primary transfer nips are thereby formed at multiple contact sections between the process units 4Y, 4C, 4M, and 4Bk and the transfer belt 5*a* pressed thereagainst in this way. Further, a secondary transfer roller 5*e* also presses against the driving roller 5*b* from and via an outer circumferential surface of the transfer belt 5*a*. Thus, a secondary transfer nip is thereby formed at a contact section between the secondary transfer roller 5*e* and the transfer belt 5.

A belt-cleaning unit 6 is positioned between the secondary transfer nip and the process unit 4Y. The belt-cleaning unit 6 includes a toner-cleaning device 6, not shown, to remove toner remaining on the outer surface of the transfer belt 5 during the transfer process executed in the secondary transfer nip. The belt-cleaning unit 6 also includes a toner transferring hose to transport waste toner thus removed to a waste toner container.

The sheet-feeding cassette 7 is provided at the bottom of the apparatus body 2 and includes a recording sheet cassette 7*a* to accommodate multiple recording sheets P therein and a sheet-feeding roller 7*b*. In the sheet-feeding cassette 7, the sheet-feeding roller 7*b* extracts the recording sheets P one by one from the recording sheet cassette 7*a* and feeds it to a transporting path R.

A sheet ejection tray 8 is provided on the top of the apparatus body 2 above the exposing unit 3. The sheet ejection tray 8 includes a tray 8*a* to accommodate multiple recorded recording sheets P thereon and a pair of sheet ejection rollers 8*b*. In the sheet ejection tray 8, the recorded sheets P discharged by the pair of ejection rollers 8*b* from the transporting path R are sequentially stacked on the tray 8*a* one at a time.

The registration roller unit 9 is configured by a pair of rollers to adjust a conveyance time to restart conveying the recording sheet P sent from the sheet-feeding roller 7*b* provided in the sheet-feeding cassette 7 and staying thereafter in the transporting path R. Between the registration roller 9 and the sheet-feeding roller 7*b* on the transporting path R, a registration sensor, not shown, is disposed in the apparatus body 2 to detect a tip of the recording sheet P when it passes therethrough. When the registration sensor detects the tip of the recording sheet P (i.e., passage) and a prescribed time has elapsed, the recording sheet P strikes the registration roller unit 9 and temporarily stops there. The registration roller 9 rotates again at a prescribed time while grasping the recording sheet P striking thereat and conveys it to the secondary transfer nip. The prescribed time corresponds to a time when a superimposed full-color toner image reaches the secondary transfer nip as the transfer belt 5*a* rotates, for example.

Here, as shown in FIGS. 2 and 3, the fixing device 10 includes a housing 41, a pair of locking members 42 and 43, a pair of switching levers 44 and 45, and a pair of operating sections 46 and 47. The locking members 42 and 43, the switching levers 44 and 45, and the operating sections 46 and 47 collectively constitute a locking mechanism in this embodiment of the present invention. The locking mechanism also includes a pressure mechanism, not shown, to press the switching levers 44 and 45 to place the locking members 42 and 43 in locking positions, respectively. The pressure mechanism is configured by an elastic member such as a torsion spring, etc. The fixing device 10 also includes a pair of supporting fixtures 48 and 49 to pivotally secure the fixing mechanism 50 and the pair of locking members 42 and 43 to the housing 41. The fixing device 10 further includes a control section, not shown, to control temperature and driving performance, such as fixing temperature, etc., of the fixing mechanism 50.

Figure 6:
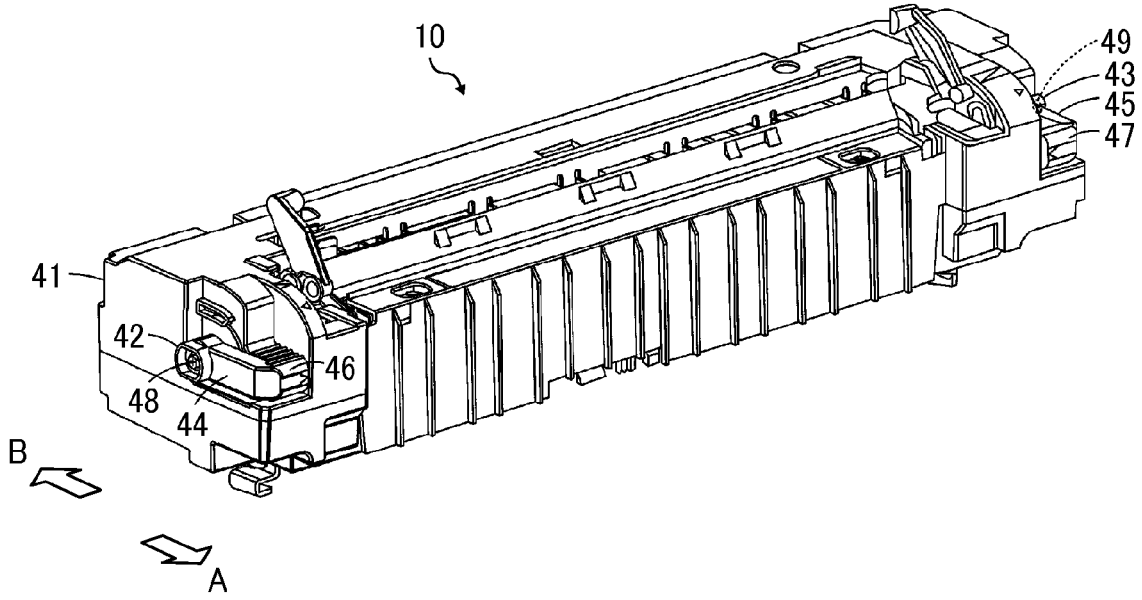
FIG. 6 is a perspective view illustrating the fixing device in an unlocked position when a switching lever is pivoted downward to an unlocking position according to one embodiment of the present invention.
Figure 7:
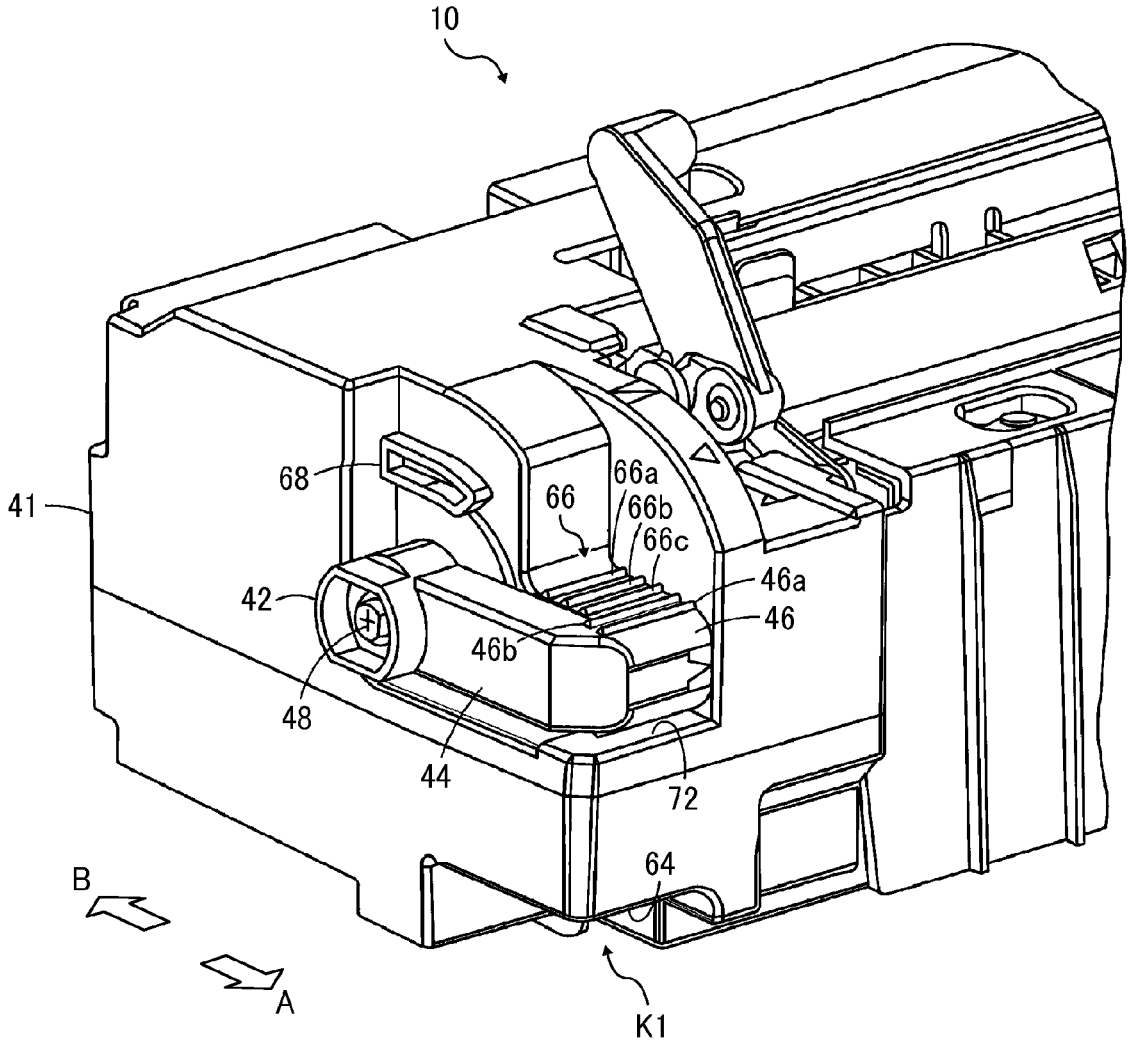
FIG. 7 is an enlarged perspective view partially illustrating the fixing device of FIG. 6.
Figure 8:
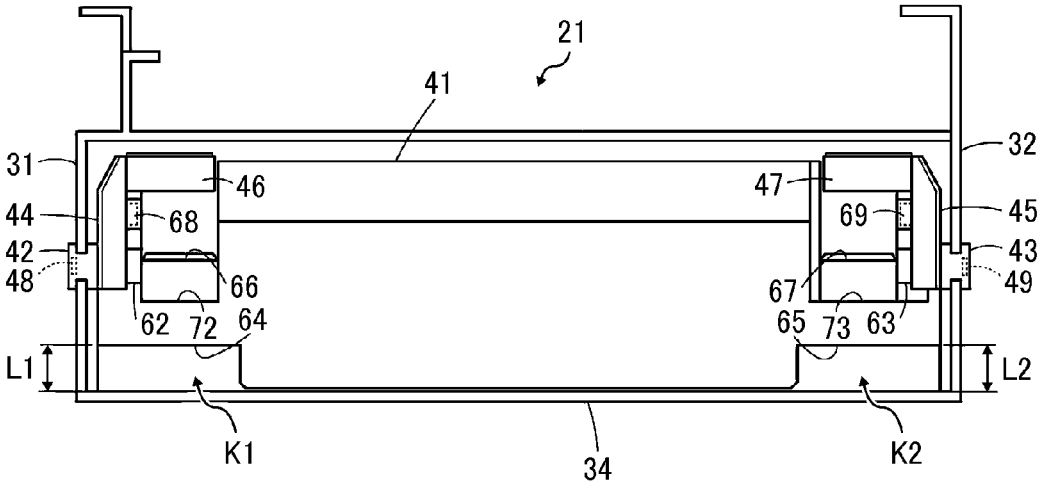
FIG. 8 is a front view illustrating the holding frame and the fixing device when the fixing device is attached to the holding frame according to one embodiment of the present invention.

Further, as shown in FIGS. 6 to 8, the housing 41 accommodates the fixing mechanism 50 inside thereof. The housing 41 also includes a pair of support sections 62 and 63, a pair of first handling sections 64 and 65, and a pair of second handling sections 66 and 67, a pair of upper interference sections 68 and 69, and a pair of lower interference members 72 and 73 acting as operating section-strikers. The housing 41 also accommodates a control unit, not shown, inside thereof. The housing 41 further includes a positioning section, not shown, at positions corresponding to the positioning pins 35 and 36 of the holding frame 21 provided to position the fixing device 10 when the fixing device 10 is attached to the holding frame 21.

The housing 41 is made of resins such as engineering plastics, etc., having prescribed mechanical strength, abrasion resistance, and heat resistance to rarely reach high-temperature. The engineering plastics includes, for example, resins, such as polyacetal (POM), polyamide (PA), polycarbonate (PC), polybutylene terephthalate (PBT), ultra high molecular weight polyethylene (UHPE), etc.

As shown in FIG. 8, the supporting section 62 is formed protruding in a prescribed direction to pivotally support the locking member 42 on the left side in the housing 41 when viewed in a direction as shown by arrow A in FIG. 7. Similar to the supporting section 62, the supporting section 63 is formed protruding in a prescribed direction to pivotally support the locking member 43 on the right side in the housing 41 when viewed in the direction as shown by arrow A in FIG. 7 as well.

Figure 9:
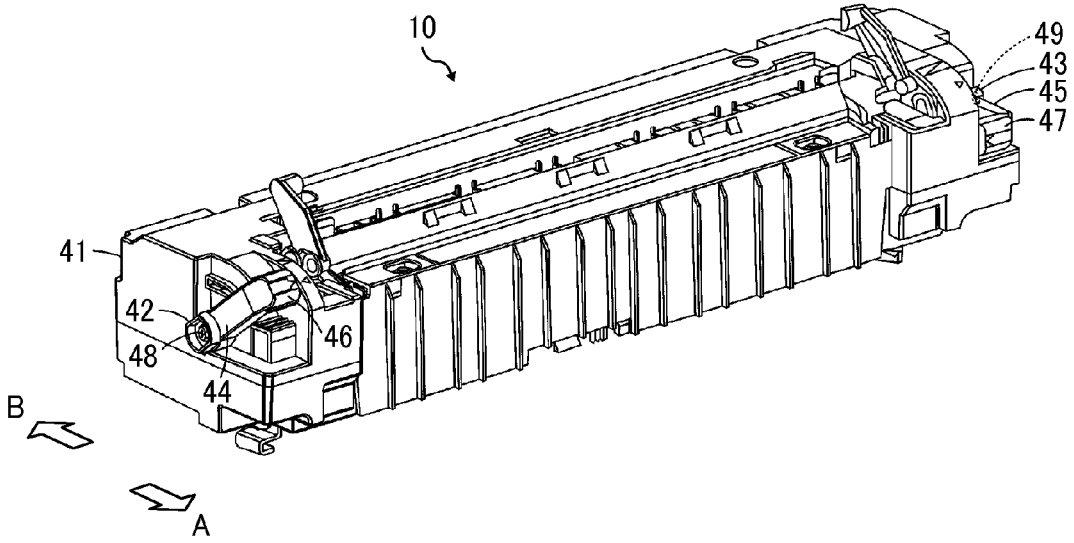
FIG. 9 is a perspective view illustrating the fixing device in a locked position when the switching lever is upwardly pivoted according to one embodiment of the present invention.
Figure 10:
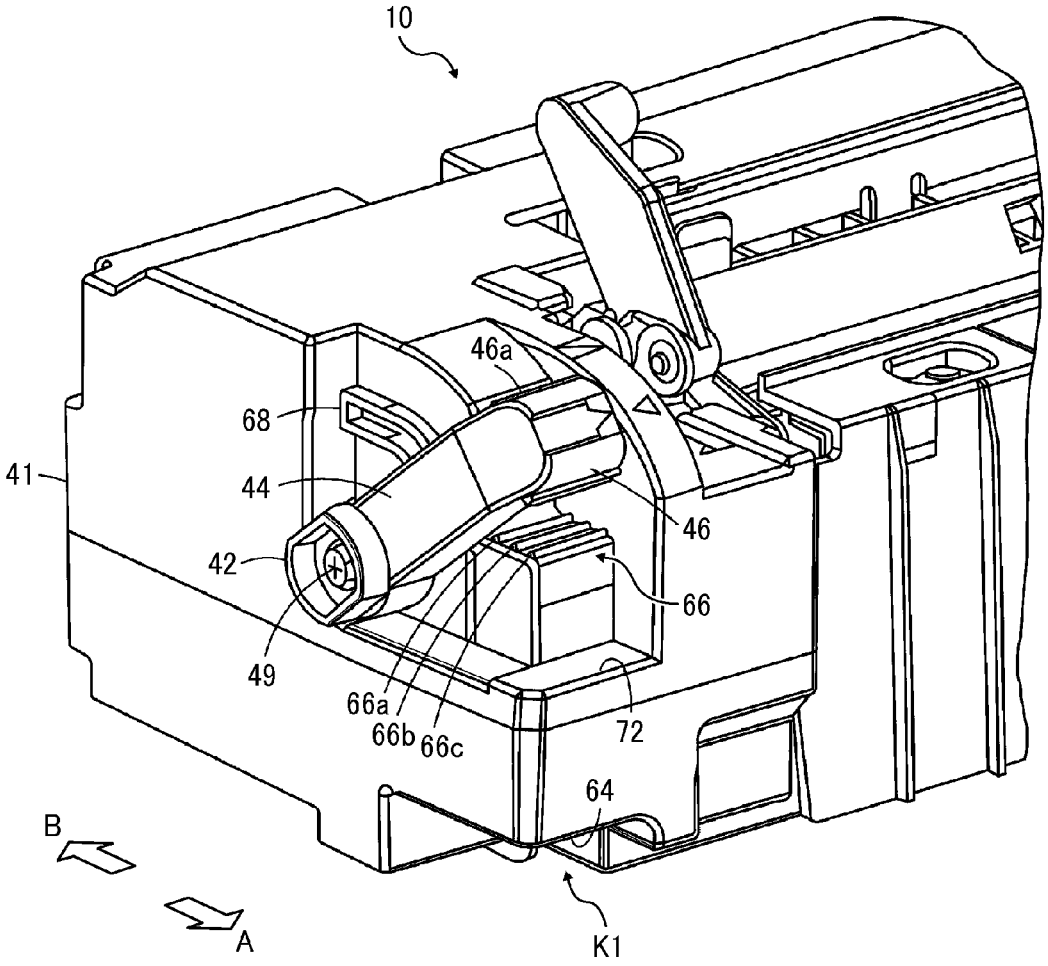
FIG. 10 is an enlarged perspective view partially illustrating the fixing device of FIG. 9.

The first handling section 64 is configured by a flat bottom plane provided on a lower side surface of the housing 41 in a vertical direction. Below this first handling section 64, a space K1 having a front side opening and a left side opening (when viewed in the direction as shown by arrow A in FIG. 7) is formed at a locking position providing a distance L1 to the bottom plate 34 of the holding frame 21 when the housing 41 is locked in the holding frame 21 as shown in FIGS. 9 and 10. This space K1 is enabled to be able to take a holding posture capable of safely handholding the fixing device 10 when the fixing device 10 is either detached or attached.

Similar to the first handling section 64, the first handling section 65 is also configured by a flat bottom plane provided on the lower side surface of the housing 41 in a vertical direction as well. Below this first handling section 65, a space K2 having a front side opening and a right side opening (when viewed in the direction as shown by arrow A in FIG. 7) is formed at a locking position when the housing 41 is locked in the holding frame 21 providing a distance L2 to the bottom plate 34 of the holding frame 21 as shown in FIGS. 9 and 10 as well. Similar to the space K1, the space K2 is also enabled to be able to take a holding posture capable of safely handholding the fixing device 10 when the fixing device 10 is either detached or attached.

Since the first handling sections 64 and 65 are provided in the lower side in the housing 41 in the vertical direction, the fixing device 10 can be safely supported and held from the lower side thereof. Further, since the first handling sections 64 and 65 are provided at the left and right side ends of the housing 41, the housing 41 can be manually held by both hands, respectively. The first handling sections 64 and 65 can be configured by the other structure than the flat bottom plane as well. For example, the first handling sections 64 and 65 can include multiple irregularities so as to prevent slipping of a finger when the fixing device 10 is manually removed. Otherwise, the first handling sections 64 and 65 can also include a friction member or an insulation member in the lower side surface to be easily handled.

The second handling section 66 is provided at an upper side in the housing 41 adjacent to the operating section 46 in a direction as shown by arrow B in FIG. 7 when the operating section 46 is in the unlocking position and the housing 41 is accordingly unlocked in the holding frame 21 as shown in FIGS. 6 and 7. Further, multiple linear convex portions 66*a*, 66*b*, and 66*c* are formed in an upper side surface of the second handling section 66 extending substantially perpendicular to a detachment and attachment direction of the housing 41.

Similar to the (left side) second handling section 66, the (right side) second handling section 67 is also provided at an upper side in the housing 41 adjacent to the operating section 47 in the direction as shown by arrow B in FIG. 7 when the operating section 46 is in the unlocking position and the housing 41 is accordingly unlocked in the holding frame 21 as shown in FIGS. 6 and 7. Further, multiple linear convex portions 67*a*, 67*b*, and 67*c* are also formed in an upper side surface of the second handling section 67 as well extending substantially perpendicular to a detachment and attachment direction of the housing 41. Since the multiple linear convex portions 66*a*, 66*b*, 66*c*, 67*a*, 67*b*, and 67*c* are provided on these second handling sections 66 and 67, slipping of the hands and fingers can be prevented when the operating sections 46 and 47 of the switching lever 44 and 45 are handled. Further, even when the operating sections 46 and 47 reach high temperature, the second handling sections 66 and 67 can be safely handled, because the hands and fingers touch these multiple convex portions and accordingly heat hardly completely travels to the hands and fingers due to point contact.

These second handling sections 66 and 67 can be configured by structures other than the above-described multiple linear convex portions. For example, the second handling sections 66 and 67 can be configured by multiple sprinkles of irregularities so as to prevent slipping of the finger when the fixing device 10 is removed. Otherwise, the second handling sections 66 and 67 can be configured to have structures having a friction member or an insulation member in the upper surface side thereof to be easily handled.

As mentioned above, the first and second handling sections 64, 65, 66, and 67 are provided at lateral ends perpendicular to the conveyance direction of the recording sheet P in the housing 41.

Further, as shown in FIGS. 7 and 10, the upper interference section 68 is formed protruding toward the locking member 42 at a position distanced from the (left side) second handling section 66 in the direction as shown by arrow B. The upper interference section 68 is enabled to guide swinging movement of the swinging lever 44 while interfering with the switching lever 44. Further, as shown in FIG. 8, similar to the (left side) upper interference section 68, the (right side) upper interference section 69 is also formed protruding toward the locking member 43 at a position distance from the (right side) second handling section 67 in the direction as shown by arrow B. The upper interference section 68 is enabled to guide swinging movement of the swinging lever 45 while interfering with the switching lever 45 as well.

Figure 13:
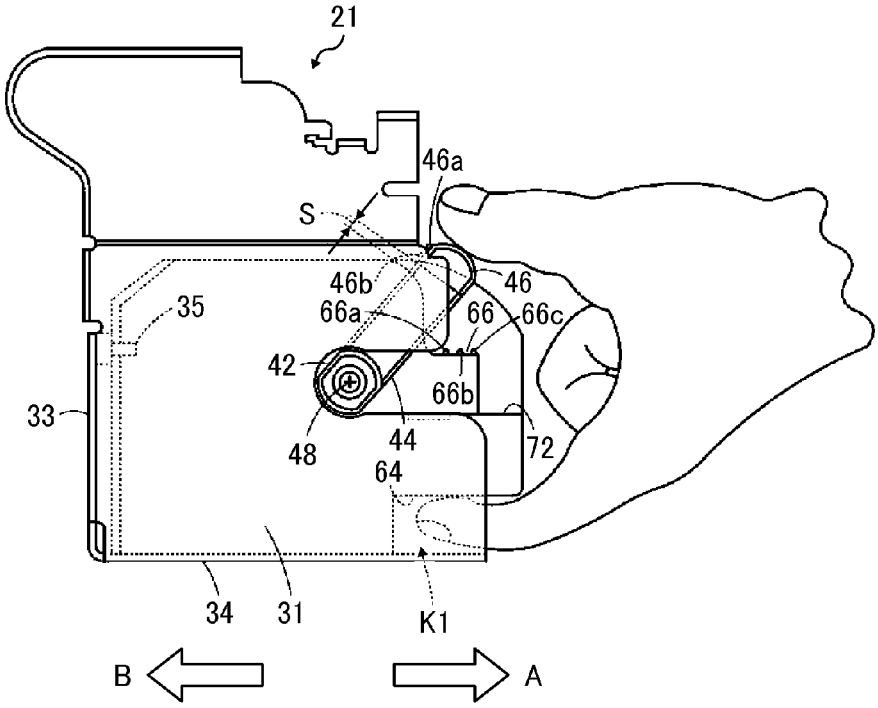
FIG. 13 is a left side view illustrating an aspect of the fixing device when an operator manipulates the operating section in a locking position according to one embodiment of the present invention.

As shown in FIGS. 7 and 10, a (left side) under interference section 72 is flat and is formed adjacent to the (left side) second handling section 66 in the direction as shown by arrow A. The under interference section 72 is enabled to prohibit a swinging motion of the operating section 46 by interfering with the operating section 46. As shown in FIG. 13, similar to the (left side) under interference section 72, a (right side) under interference section 73 is also flat and is formed adjacent to the (right side) second handling section 67 in the direction as shown by arrow A. Thus, since these under interference sections 73 are enabled to prohibit swinging motions of the operating sections 46 and 47 by interfering with the operating sections 46 and 47, these under interference sections 73 collectively constitute an operating section-striker according to one embodiment of the present invention.

Figure 11A:
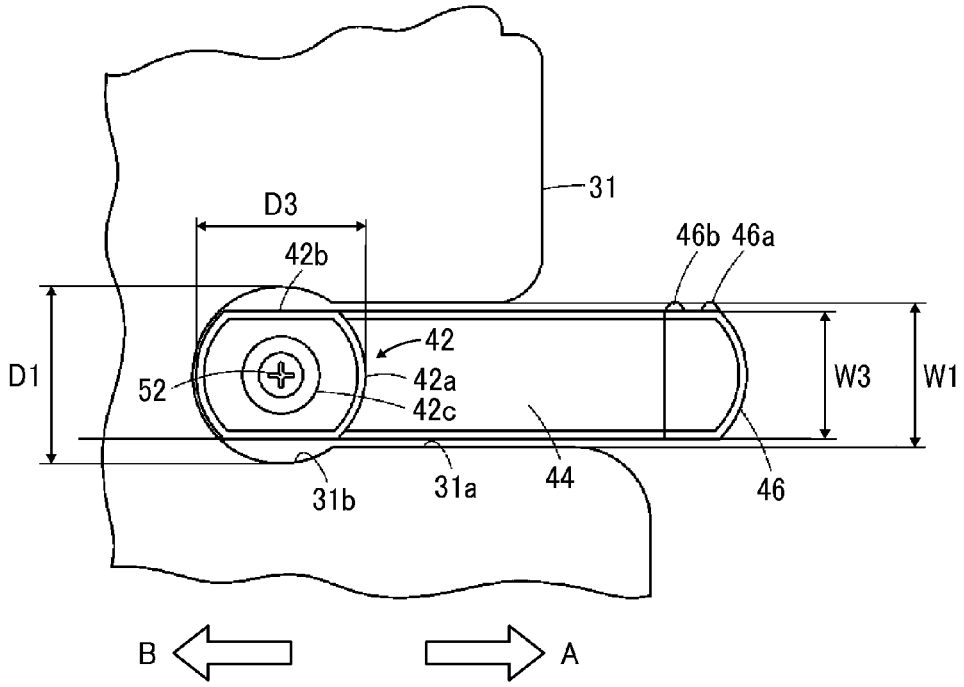
FIG. 11A is an enlarged side view partially illustrating the left side of the fixing device in the unlocked position when the switching lever is pivoted downward to an unlocking position according to one embodiment of the present invention.
Figure 11B:
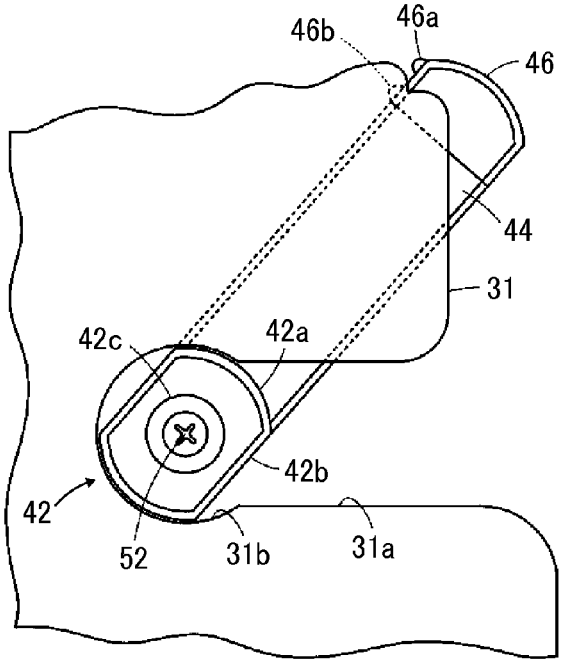
FIG. 11B also is an enlarged side view partially illustrating the left side of the fixing device in the locked position when the switching lever is pivoted upward to a locking position according to one embodiment of the present invention.

Further, the locking member 42 includes an arc portion 42*a*, a flat portion 42*b*, and a mounting portion 42*c* as shown in FIGS. 7, 9, 11A, and 11B. Specifically, as shown in FIG. 11A, the arc portion 42*a* includes a slightly smaller diameter D3 than a diameter D1 of the through hole 31*b*. Thus, the arc section 42*a* is inserted into the through hole 31*b* and is enabled to rotate along the through hole 31*b* serving as a guide therefor as shown in FIG. 11B. The flat section 42*b* includes a slightly narrow width W3 than a width W1 of the slit 31*a*. Thus, the flat portion 42*b* is inserted into the slit 31*a* and is enabled to move to both directions as shown by arrows A and B along the slit 31*a* serving as a guide therefor.

Figure 12A:
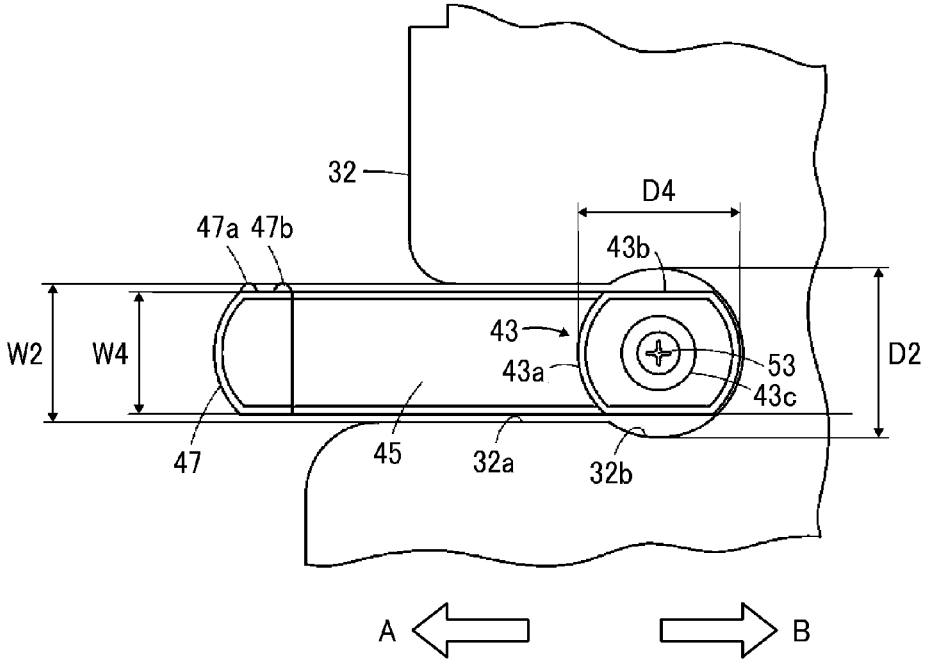
FIG. 12A is an enlarged side view partially illustrating the right side of the fixing device in the unlocked position when the switching lever is pivoted downward to the unlocking position according to one embodiment of the present invention.
Figure 12B:
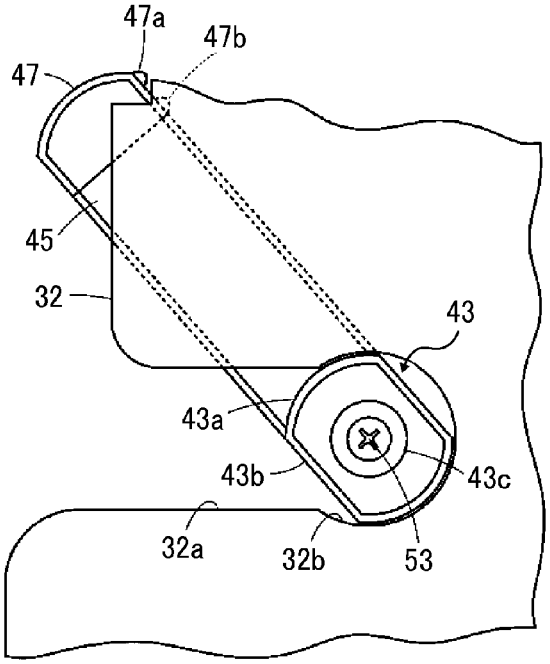
FIG. 12B also is an enlarged side view partially illustrating the right side of the fixing device in the locked position when the switching lever is pivoted upward to the locking position according to one embodiment of the present invention.

Further, the (right side) locking member 43 similarly includes an arc portion 43*a*, a flat portion 43*b*, and a mounting portion 43*c* as shown in FIGS. 12A and 12B. Specifically, as shown in FIG. 12A, the arc portion 43*a* includes a slightly smaller diameter D4 than a diameter D2 of the through hole 32*b*, and is inserted into the through hole 32*b* and is enabled to rotate along the through hole 32*b* serving as a guide therefor as shown in FIG. 12B. The (right side) flat section 43*b* similarly includes a slightly narrow width W4 than a width W2 of the slit 32*a*, and is inserted into the slit 32*a* and is enabled to move to both directions as shown by arrows A and B along the slit 32*a* serving as a guide therefor.

Further, as shown in FIGS. 10, 11A, and 11B, one end of the switching lever 44 is integrally connected to the locking member 42 while the other end is similarly connected to the operating section 46 to convey operational effect of the operating section 46 to the locking member 42. Thus, the switching lever 44 is configured to switch from a locking position to lock the fixing device 10 in the holding frame 21 to an unlocking position to unlock the fixing device 10 in the holding frame 21 vice versa. The switching lever 44 includes a width W3 and is integrally formed with the locking member 42 and the operating section 46. A side of the switching lever 44 facing the left side plate 31 interferes with the upper interference section 68 to smoothly execute swinging.

Figure 16:
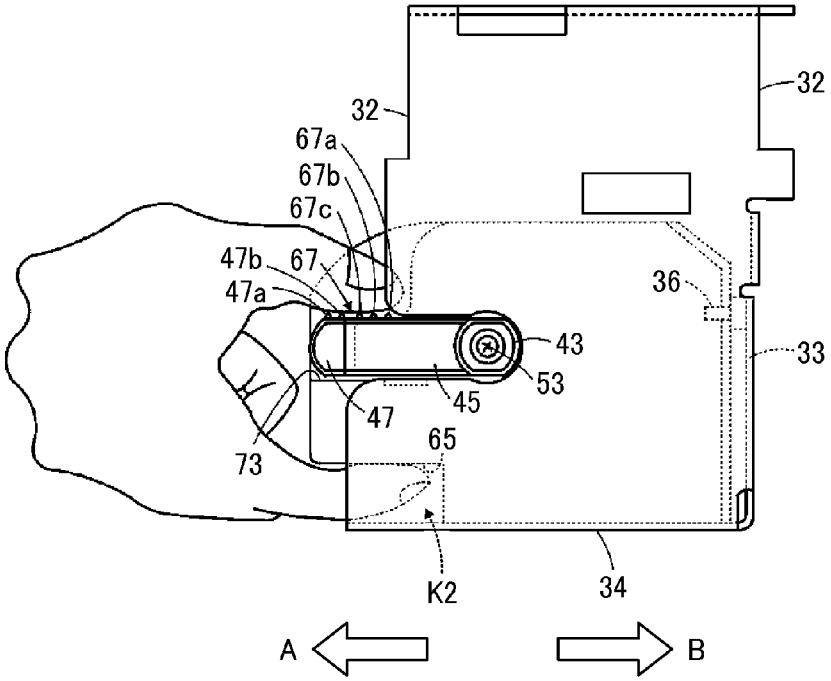
FIG. 16 is a right side view illustrating an aspect of the fixing device when the fixing device starts exiting from the holding frame according to one embodiment of the present invention.

Further, as shown in FIGS. 12A, 12B, and 16, similar to the (left side) switching lever 44, one end of the (right side) switching lever 45 is integrally connected to the locking member 43 while the other end is similarly connected to the operating section 47 to convey operational effect of the operating section 47 to the locking member 43. The switching lever 45 is also configured to switch from a locking position to lock the fixing device 10 in the holding frame 21 to an unlocking position to unlock the fixing device 10 in the holding frame 21 vice versa. The switching lever 45 also includes a width W4 and is integrally formed with the locking member 43 and the operating section 47 as well. A side of the switching lever 45 facing the right side plate 32 interferes with the upper interference section 69 to smoothly execute swing.

Further, as shown in FIGS. 10, 11A, and 11B, the operating section 46 protrudes from the switching lever 44 toward the second handling section 66, and a side portion thereof in the direction as shown by arrow A includes an arc-shape. Further, multiple linear convex portions 46*a* and 46*b* are formed in the operating section 46 to prevent fingers from slipping when holding the operating section 46. Further, as shown in FIGS. 12A, 12B, and 16, similar to the (left side) operating section 46, the (right side) operating section 47 also protrudes from the (right side) switching lever 45 toward the (right side) second handling section 67, and a side portion thereof in the direction as shown by arrow A includes an arc-shape as well. Further, multiple linear convex portions 47*a* and 47*b* are also formed in the operating section 47 to prevent fingers from slipping when holding the operating section 47 as well.

Further, as shown in FIG. 13, when the switching levers 44 and 45 are switched to the locking position and are provided at the upper side in the housing 41, a given gap having a prescribed interval is formed between the operating section 46 and 47 and the housing 41. Therefore, the given gap S can avoid the housing 41 and the operating section 46 and 47 from interfering with each other.

Further, the operating sections 46 and 47 can also be configured by the other structure than the above-described linear multiple convex portions as well. For example, to prevent the finger from slipping when attaching and detaching the fixing device 10, upper and lower side surfaces of each of the operating section 46 and 47 can be composed of scattered unevenness. Further, to easily hold the operating sections 46 and 47, a given friction member or an insulation member can be adhered to the upper and lower side surfaces of each of the operating section 46 and 47.

Further, the supporting fixtures 48 and 49 serving as rolling motion fulcrums are configured by fasteners, such as screws, bolts, etc., and pivotally fasten the locking members 42 and 43 to the supporting members 62 and 63 provided in the housing 41, respectively. Thus, the locking members 42 and 43 are pivoted around the supporting fixtures 48 and 49, respectively.

In this embodiment, the locking position to lock the housing 41 in the holding frame 21 can be switched to the unlocking position to unlock the housing 41 in the holding frame 21 vice a versa by using the slit 31*a* and the through hole 31*b* formed in the left side plate 31, the locking member 42, the supporting fixture 48, and the supporting section 62 for the housing 41. Therefore, the slit 31*a* and the through hole 31*b* of the left side plate 31, the locking member 42, the supporting fixture 48, and the supporting section 62 for the housing 41 collectively constitute a locking mechanism according to one embodiment of the present invention.

Similarly, the locking position to lock the housing 41 in the holding frame 21 can be switched to the unlocking position to unlock the housing 41 in the holding frame 21 vice a versa by using the slit 32*a* and the through hole 32*b* formed in the right side plate 32, the locking member 43, the supporting fixture 49, and the supporting section 63 for the housing 41. Therefore, the slit 32*a* and the through hole 32*b* formed in the right side plate 32, the locking member 43, the supporting fixture 49, and the supporting section 63 for the housing 41 collectively constitute the locking mechanism according to one embodiment of the present invention as well.

Figure 15:
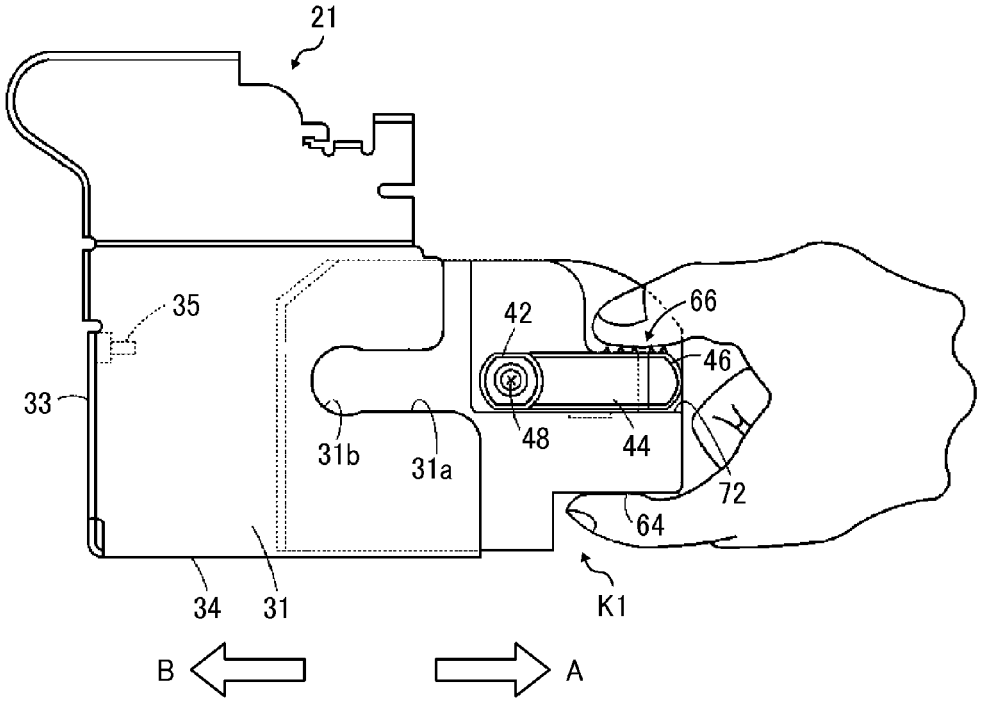
FIG. 15 is a left side view illustrating an aspect of the fixing device when the fixing device has almost exited from the holding frame according to one embodiment of the present invention.

Further, as shown in FIG. 15, since the operating section 46 and the first and second handling sections 64 and 66 can be handled when attaching and detaching the fixing device 10 to and from the holding frame 21, these members collectively constitute a handling section according to one embodiment of the present invention. Similarly, as shown in FIG. 16, since the operating section 47 and the first and second handling sections 65 and 67 can be handled when attaching and detaching the fixing devices 10 to the holding frame 21, these members collectively constitute a handling section in this embodiment of the present invention as well.

Further, as shown in FIG. 2, the fixing unit 50 includes a heat source 51, a heating roller 52, a fixing roller 53, a fixing belt 54, a pressing roller 55, a belt-tension generating roller 56, a belt-cleaning roller 57, and a driving unit, not shown. Here, a toner image on a recording sheet P is pressed and heated, and is thereby fixed thereon when it passes through a nip N formed between the fixing belt 54 and the pressing roller 55 in the fixing unit 50. Further, the recording sheet P is separated from the fixing belt 54 when it is discharged from the nip N, and is further conveyed toward the ejection roller 8*b* through the transporting path R.

A heat source 51 is installed on the inner circumferential side of the heating roller 52 and is attached to the housing 41. The heat source 51 is configured by a publicly known radiant heater with a single light-emitting region for heating the heating roller 52. For example, this heater may include a halogen heater directly using radiant heat emitted from a halogen lamp, a ceramic heater composed of a resistance wiring embedded in ceramic, and a carbon heater composed of a quartz tube filled with carbon fiber and inert gas or the like. Further, the above-described control unit controls power supply to the heater 23. Here, the heater may be composed of the other heat source than the publicly known radiant heater with the single light-emitting region. For example, the heater may be configured by a publicly known electromagnetic induction heater to generate heat based on electromagnetic induction.

The heating roller 52 is freely rotatably supported by the housing 41, and is configured by a publicly known driven roller driven as the fixing roller 53 rotates. The heating roller 52 conveys and transfers heat propagated from the heat source 51 to the fixing belt 54. The fixing roller 53 is supported by the housing 41 to rotate counterclockwise while receiving driving power from a motor provided in a driving unit, each not shown, and forms the nip N to render the recording sheet P to pass it through in cooperation with the pressing roller 55.

The fixing belt 54 is wound around the fixing roller 53 and the heating roller 52, and is configured by a publicly known endless belt. The fixing belt 54 includes a belt substrate, an elastic layer formed on the belt substrate, and a releasing layer formed overlying an outer circumferential surface of the elastic layer. The fixing belt 54 is directly heated by the heating roller 52 and heats the recording sheet P up to a degree of fixing temperature to fix an unfixed toner image onto the recording sheet P while conveying the recording sheet P downstream.

Further, the pressing roller 55 includes a metal core roller, an elastic layer overlying an outer circumferential surface of the metal core roller, and a releasing layer overlying an outer circumferential surface of the elastic layer, and may serve as a known driven roller to be driven and rotated as the fixing roller 53 rotates. The pressure roller 55 is movably supported in a prescribed direction to either approach or separate from the fixing roller 53.

The belt-tension generating roller 56 is also rotatably supported by the housing 41 to adjust a tension of the fixing belt 54 extended between the heating roller 52 and the fixing roller 53. The belt-cleaning roller 57 is rotatably supported by the housing 41 again to clean stains, such as residual toner, sheet dust, etc., adhering onto the fixing belt 54.

Further, as shown in FIG. 2, a waste toner container 11 is provided between the transfer belt unit 5 and the sheet-feeding cassette 7. To an inlet of the waste toner container 11, a toner transferring hose, not shown, stretched from the belt cleaning device 6 is connected. Thus, in the waste toner container 11, waste toner conveyed by the toner transferring hose is accommodated.

Now, a basic operation of the above-described color image forming apparatus 1 is described herein below with reference to FIG. 2. When the color image forming apparatus 1 starts forming an image, a photoconductive drum of each of the process units 4Y, 4C, 4M, and 4Bk is driven and rotated clockwise in the drawing by a driving mechanism, not shown, and surfaces of the photoconductive drums 4*d* are uniformly charged by the charging rollers 4*r* each in a prescribed polarity, respectively. Subsequently, onto the surface of the charged photoconductive drums 4*d*, laser light beams are emitted from the exposing device 3, and electrostatic latent images are thereby formed on the surfaces of the photoconductive drums 4*d*, respectively. Image information to provide exposure to the photoconductive drums 4*d* respectively include yellow, cyan, magenta and black component color images obtained by resolving a given full-color image. Electrostatic latent images formed on the photoconductive drums 4*d* are then rendered visible as toner images (i.e., developed images) when component color toner particles are supplied to the electrostatic latent images by developing devices 4*g*, respectively.

Further, when the driving roller 5*b* is driven and rotated clockwise in the drawing, the transfer belt 5*a* is driven and circulated in a direction as shown by arrow in the drawing. A constant voltage or current controlled voltage having an opposite characteristic to a polarity of charge provided to the toner is applied at that time to each of the primary transfer rollers 5*d*. With this, a transfer electric field is formed in each of the primary transfer nips formed between the primary transfer rollers 5*d* and the photoconductive drums 4*d*, respectively. Further, the component color toner images formed on the photoconductive drums 4*d* in the process units 4Y, 4C, 4M, and 4Bk are transferred and superimposed successively onto the transferred belt 5A in above-described transfer field formed in the above-described primary transfer nips, respectively. In this way, a full-color toner image is formed and borne on its surface of the transfer belt 5*a*.

Further, residual toner adhering to the surface of each of the photoconductive drums 4*d* after the above-described toner image transferring process is removed by a cleaning blade 4*b*. Subsequently, the surface of each of the photoconductive drums 4*d* receives a charge removing process, in which electric charge remaining thereon is removed by a charge-removing unit, not shown, so that a surface potential is thereby initialized to prepare for the next image formation in each of the photoconductive drums 4*d*.

Further, when the toner image formation to form a toner image by adhering toner to the electrostatic latent image formed on each of the photoconductive drums 4*d* by the development device starts, the sheet feeding roller 7*b* disposed on the bottom of the color image forming apparatus also starts rotating at a prescribed time due to driving of a motor to send the recording sheet P contained in the sheet feeding cassette 7 to the transporting path R. The recording sheet P sent to the transporting path R is timed by the pair of registration roller 9, and is further sent to a secondary transfer nip formed between the secondary transfer roller 5*e* and the driving roller 5*b* opposed to it. At this moment, a transfer voltage having an opposite polarity to that of the charged toner in the toner image borne on the transfer belt 5*a* is applied to the secondary transfer roller Se, so that another electric transfer field is formed in the secondary transfer nip.

Further, the toner image borne on the transfer belt 5 is transferred onto the recording sheet P at once in the transfer field formed in the secondary transfer nip. The recording sheet P with the toner image transferred in this way is then conveyed to the fixing device 10, and is heated and pressed by the fixing belt 54 and the pressing roller 55 therebetween, so that the toner image is fused thereon.

The recording sheet P bearing the fixed toner image in this way is then separated from the fixing belt 54 by a separating mechanism, not shown, and is ejected onto a tray 8*a* of an sheet ejection tray 8 by a sheet ejection roller 8*b*. Further, toner residues remaining on the transfer belt 5A after the secondary transfer process is then removed by the belt-cleaning device 6, and is transported and collected in the waste toner container accommodating waste toner.

Heretofore, one embodiment is described when the full-color image is formed on the recording sheet P during the color image formation process. However, a monochromatic image can be formed only by using any one of the four process units 4Y, 4C, 4M, and 4Bk. Further, a dual or trivalent color image can also be formed only by using two or three process units.

Now, various operations to remove the fixing device 10 according to this embodiment and attach the same to and from the apparatus body 2 of the color image forming apparatus 1 are described with reference to applicable drawings.

Initially, detaching operation is described with reference to FIG. 1. As there shown, a front cover 1*a* of the color image forming apparatus 1 is opened to expose the fixing device 10. In this state, the fixing device 10 is locked in the holding frame 21 that partially constitutes the apparatus body 2 of the color image forming apparatus 1 as described earlier. Specifically, as shown in FIG. 13, the left-side switching lever 44 of the fixing device 10 is continuously upwardly pressed by the pressure mechanism, not shown, so that the locking position of the locking member 42 is maintained. More specifically, at the locking position, the locking member 42 is inserted into the through hole 31*b* as shown in FIG. 11B while (horizontal) movement of the locking member 42 in a direction as shown by arrow A is prohibited and the fixing device 10 is locked in the holding frame 21 at the locking position.

Then, as shown in FIG. 13, an operator hooks his or her left thumb on the operating section 46 of the left side switching lever 44. Simultaneously, the operator inserts his or her index finger of the left hand into the left side space K1 until his or her finger is thereby partially hidden (e.g., the operator hides the finger from a tip to the first joint thereof), and touches the left side first handling section 64 with the index finger.

At the same time, as shown in FIG. 12B, the operator similarly hooks his or her right thumb on the operating section 47 of the right side switching lever 45. The operator also inserts his or her index finger of the right hand into the right side space K2 until his or her finger is thereby partially hidden (e.g., the operator hides the finger from a tip to the first joint thereof), and touches the right side first handling section 65 with the index finger. Hence, due to supporting the bottom of it with each of his left and right hand index fingers, even a relatively heavy fixing device 10 can be safely held.

Although the left side operating section 46 of the fixing device 10 is manipulated with his or her left hand, while the right side operating section 47 of the fixing device 10 is operated with his or her right hand as mentioned above, only the left hand operation is hereinafter described mainly. Because, the left and right hand operations are almost the same with each other.

Figure 14:
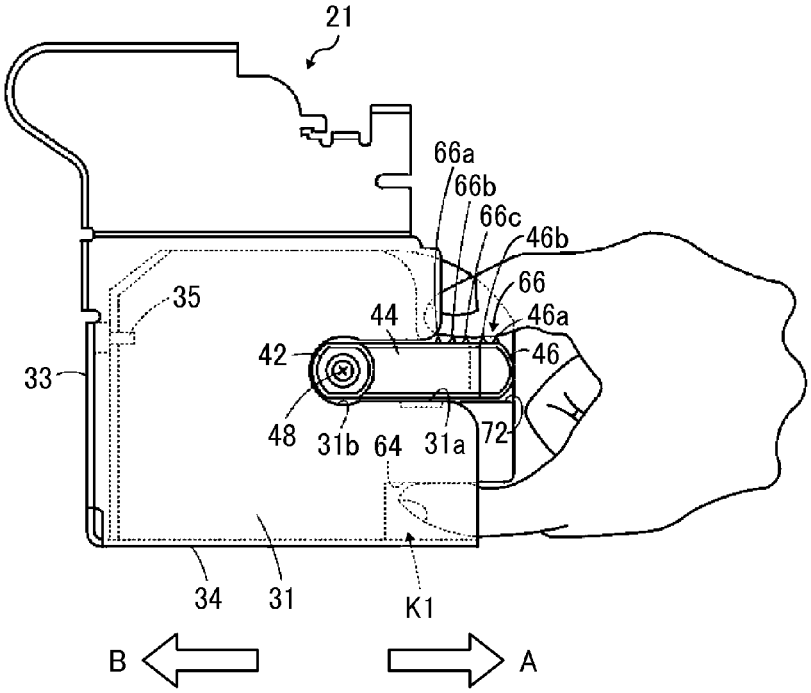
FIG. 14 is a left side view illustrating an aspect of the fixing device when an operator manipulates the operating section in an unlocking position according to one embodiment of the present invention.

In any way, as shown in FIG. 14, the thumb subsequently presses the left switching lever 44 and the operating section 46 downward until the left switching lever 44 and the operating section 46 contact the lower interference section 72. At that moment, the locking member 42 rotates clockwise to cause the flat portion 42*b* thereof to face sideways (to be horizontal). Specifically, the locking member 42 becomes (horizontally) movable along the slit 31*a* therein in the direction as shown by arrow A, so that the fixing device 10 is unlocked from the holding frame 21. That is, the switching lever 44 takes the unlocking position.

Subsequently, as shown in FIG. 15, by continuously pressing the switching lever 44 and the operating section 46 downward with the thumb while holding the fixing device 10 together with the index finger, he or she withdraws the fixing device 10 toward the front side in the direction as shown by arrow A. Further, as shown in FIG. 16, similar to the operation executed by the left hand, by continuously pressing the right side switching lever 45 and the operating section 47 downward with the thumb while holding the fixing device 10 with the thumb and the index finger, he or she withdraws the fixing device 10 toward the front side in the direction as shown by arrow A.

When the fixing device 10 is drawn out to the front side, multiple positioning pins 35 and 36 as shown in FIG. 3 are drawn out from the fixing device 10, and the locking member 42 is separated along the slit 31*a* therefrom. When the fixing device 10 is drawn out to the front side, and a lower side surface of the housing 41 of the fixing device 10 is moved along a bottom plate 34 of the holding frame 21 as shown in FIG. 3 thereon, the bottom plate 34 can hold the relatively heavy fixing device 10 having a prescribed weight. Therefore, even if only the left and right thumbs and the index fingers of from the tips until the first joints thereof are used to hold the handling sections 64 and 65, respectively, the fixing Unit 10 can be readily pull out.

After the fixing device 10 is drawn out from the holding frame 21, the operator can carry the fixing device 10 while keeping a state of the thumb and the index finger as is. At this moment, the operator can more effortlessly keep the fixing device, because the space K1 is opened sideward and he or she is possible to more deeply insert his or her index finger into the space K1 after the fixing device 10 is drawn out from the holding frame 21. More specifically, by displacing the groin side of the index finger currently inserted into the space K1 from the front side sideward and contacting an inner side of the first handling section 64 with the index finger, the operator can hold the first handling section 64 from both the lateral and front sides thereof.

Further, even when relatively heavy fixing device 10 having a prescribed weight is drawn out and the index finger hooks and holds a shallow portion of the first handling section 64 on the front side thereof, since the bottom plate 34 of the holding frame 21 supports such a fixing device 10, the operator can more effortlessly keep the fixing device 10. However, when the fixing unit 10 drawn out from the holding frame 21 is lifted and carried, the bottom plate 34 of the holding frame 21 does not work. However, since the first handling section 64 includes the opening formed from a notch communicating with both the lateral and front sides as described heretofore, the operator can safely hold the backside of the fixing unit 10 close to a gravity center of the fixing device 10 by smoothly changing the insertion direction of the index finger from the front side to the left side in the space K1.

Now, attaching operation is described with reference to applicable drawing. When the fixing device 10 has been removed from the holding frame 21 of the color image forming apparatus 1, the switching levers 44 and 45 stay the locking position, because the switching levers 44 and 45 are pressed by a pressure mechanism to extend upward. In this condition, the index fingers of the both hands are brought to touch the first handling sections 64 and 65, and both thumbs are brought to touch the operating sections 46 and 47 of the switching levers 44 and 45, respectively. Then, the operator presses the switching levers 44 and 45 (via the operating sections 46 and 47) down with the thumbs and turns the locking members 42 and 43 sideways (to be horizontal), respectively. Subsequently, while continuously depressing the operating sections 46 and 47 downward with the thumbs, the operator holds the fixing device 10 with the thumbs and the index fingers and puts the fixing device 10 on the bottom plate 34 of the holding frame 21 as shown in FIG. 15.

Further, while continuously holding the fixing device 10 with both the thumbs and the index fingers, the operator pushes and moves the fixing device 10 on the bottom plate 34 into the inner side in a direction as shown by arrow B. Since the fixing device 10 is supported on the bottom plate 34 and pushing operation pushing the fixing devices 10 is eased when the fixing device 10 is pushed, shallow portions of the first handling sections 64 and 65 can be hooked by the index fingers, respectively, without causing a problem. Further, hooking portions on the first handling sections 64 and 65 can be changed to the front side for the same reason. Otherwise, the operator can be allowed to separate both the index fingers from the first handling section 64 and 65, respectively, to cause the fixing device 10 to take a natural posture to smoothly push the fixing device 10.

When the fixing device 10 is further pushed inside, multiple positioning pin 35 and 36 provided in the holding frame 21 are inserted into the housing 41 of the fixing device 10 as shown in FIG. 3. At the same time, multiple striking portions in the positioning pins 35 and 36 hit a backside of the housing 41. Hence, a position of the fixing device 10 can be determined regarding the holding frame 21 in all of lateral and longitudinal directions.

At this moment, the locking members 42 and 43 move along the slits 31*a* and 32*a* therein, and are inserted into the through holes 31*b* and 32*b*, respectively, as shown in FIGS. 11A and 12A. Further, when both thumbs stop pressing the operating sections 46 and 47, the switching levers 44 and 45 are upwardly pivoted by the pressure mechanism as shown in FIGS. 11B and 12B. Due to this, the locking sections 42 and 43 rotate counterclockwise at the same time, and the arc sections 42*a* and 43*a* fit to (engage with) the through holes 31*b* and 32*b*, respectively, so that the fixing device 10 is locked against the holding frame 21 as a result. In this state, the front cover 1*a* of the color image formation apparatus 1 shown in FIG. 1 is closed, operation to attach the fixing device 10 to the color image forming apparatus 1 have been completed.

Although a situation to hold the first handling sections 64 and 65 with both index fingers, respectively, during a series of operation of detachably attaching the fixing device 10 is described heretofore, the other fingers than both the index fingers may be additionally or alternatively used to hold the fixing device 10 as well. For example, the first handling sections 64 and 65 may be respectively handled by both of a pair of index fingers and a pair of middle fingers, respectively.

Hence, since the color image forming apparatus 1 accommodating the fixing device 10 according to one embodiment of the present invention is configured as described above, the following advantage can be obtained in accordance with various embodiments.

Specifically, according to one embodiment of the present invention, since the fixing device 10 according to one embodiment of the present invention includes pair of switching levers 44 and 45 enabled to switch from a locking state to an unlocking state to lock and unlock the housing 41 on the holding frame 21, a pair of operating sections 46 and 47, a pair of the first handling sections 64, and 65, and a pair of second handling sections 72 and 73 provided near the operating sections 46 and 47, the fixing device 10 can be quickly separated from the holding frame 21 of the color image forming apparatus 1 due to simple operation.

That is, the fixing device 10 can be easily drawn out from the holding frame 21 by unlocking the housing 41 on the holding frame 21, and manipulating the operating sections 46 and 47 without changing a way of holding the operating sections 46 and 47 while holding both the first handling sections 64 and 65.

In addition, the fixing device 10 is attachable to the holding frame 21 with simple operations as well. Further, since the fixing device 10 is enabled to be attached to the holding frame 21 by holding the operating sections 46 and 47 and the second handling sections 66 and 67 as well with both thumbs while holding the first handling sections 64 and 65 with both the index fingers, respectively, the fixing device 10 can be easily locked in the holding frame 21 without changing a way of holding the operating sections 46 and 47.

In this way, locking, unlocking, attachment, and detachment of the housing 41 of the fixing device 10 in the holding frame 21 while holding the housing 41 can be smoothly executed as a series of operations.

Since the first handling sections 64 and 65 are configured by the notches each having front and lateral side openings in a mounting direction of the housing 41, the first handling sections 64 and 65 can be easily handled from the front and lateral sides, the housing 41 can enhance mechanical strength. As a result, the fixing device 10 can be rarely broken while improving durability thereof. Further, the above-described configuration increasingly stabilizes and improves operation performance of attaching and detaching the fixing device 10. Further, the fixing device 10 can be preferably downsized while saving a space (i.e., a footprint) to occupy.

Further, in the fixing device 10 according to one embodiment of the present invention, since the pair of operating sections 46 and 47 are provided close to the second handling sections 66 and 67, when the pair of switching levers 44 and 45 is switched to the unlocking positions, respectively, directions of forces applied to the operating sections 46 and 47 when the switching levers 44 and 45 are switched to the unlocking positions and directions of forces applied to those when the housing 41 is held can be the same, respectively. As a result, the operator can preferably smoothly execute a series of switching operation switching the switching levers 44 and 45 and holding operation holding the housing 41.

Further, since the operating sections 46 and 47 are provided at the front side more than the second handling sections 66 and 67 in a condition that the switching levers 44 and 45 are pivoted downward to locate the unlocking position, the shorter thumb can smoothly touch and hold a holding section provided at the front side and the longer index finger can also smoothly touch and hold a holding section at a back side under a preferable condition in view of a size of fingers to effectively use holding power of the thumb and the index finger. As a result, the fixing device 10 can be safely held.

Further, in the fixing Unit 10 according to one embodiment of the present invention, the operating sections 46 and 47 are provided at tips of the switching levers 44 and 45, respectively, operation performance of the switching levers 44 and 45 can be upgraded. Further, even when the housing 41 is heated at relatively high temperature by heat generated and emitted during a fixing process, since the heat of the housing 41 is difficult to propagate to those, the operating sections 46 and 47 can be safely manipulated.

Further, in the fixing device 10 according to one embodiment of the present invention, since the pressure mechanisms to press and locate the switching levers 44 and 45 at the locking positions, the switching levers 44 and 45 can be automatically switched to locate the locking positions by the pressure of the pressure mechanisms, respectively, when the operating sections 46 and 47 are released from the hands. As a result, switching operation switching the switching levers 44 and 45 can be omitted and operation performance of attaching and detaching the fixing device 10 can be upgraded when the operating sections 46 and 47 are released from the hands. In addition, since pressure of the pressure mechanisms oppositely act on the housing 41 against a force of holding the housing 41 with hands when the switching levers 44 and 45 are switched to locate the unlocking positions and the housing 41 is held by holding the operating sections 46 and 47 and the holding sections, the housing 41 can be safely held at that moment as well.

Further, in the fixing unit 10 according to one embodiment of the present invention, since the spaces K1 and K2 are formed on the lower sides of the first handling sections 64 and 65, respectively, the operator can readily touch the first handling sections 64 and 65 with hand and finger upgrading operation performance. Further, since the fixing device 10 is enabled to be easily supported from the lower side thereof by touching the first handling sections 64 and 65 with hands and fingers, the fixing device 10 can be safely held as well.

Further, in fixing unit 10 according to one embodiment of the present invention, since the lower interference members 72 and 73 are provided in the housing 41 to strike the operating sections 46 and 47, respectively, when the switching levers 44 and 45 are switched to locate the unlocking positions, the lower interference members 72 and 73 can serve as stoppers to hold the switching levers 44 and 45 in the unlocking position, respectively.

Further, in the fixing device 10 according to one embodiment of the present invention, the operating sections 46 and 47, since the first handling sections 64 and 65, and the second handling sections 66 and 67 are provided at lateral ends of a conveyance path for a recording sheet P conveyed to the housing 41, i.e., a front side in a direction to leave the fixing device 10, the fixing device 10 can be safely attached or detached to and from the color image forming apparatus 1 while holding the housing 41 by hand.

In a conventional fixing device, when the fixing device is held and either drawn out or lifted, since the thumb only holds a switching lever and an area handled by the thumb is relatively small, the conventional fixing device may not be steadily held. In addition, since the switching lever is enabled to pivot and accordingly slightly includes a rattle, the conventional fixing device may not be steadily held.

By contrast, according to one embodiment of the present invention, although the fixing device 10 is drawn out basically in the same manner as in the conventional embodiment, since the second handling section 66 is provided at a position at which the switching lever pressed down by the thumb hits the lower interference section 72, the operating section 46 of the switching lever 44 and the second handling section 66 can be simultaneously handled by the thumb. (The same goes on the right side of the housing 41.)

In this way, the first handling sections 64 and 65 formed in the housing 41 can be constantly handled by the left and right index fingers, respectively, while simultaneously holding not only the operating sections 46 and 47 of the generally unstable switching levers 11 and 45 but also the second handling sections 66 and 67 with the thumbs of the left and right hands, respectively. As a result, the relatively heavy fixing device 10 can be steadily held.

Further, since the color image forming apparatus 1 according to one embodiment of the present invention includes the above-described fixing device 10, the fixing unit 10 can be steadily removed from the color image forming apparatus 1. Thus, the color image forming apparatus 1 according to one embodiment can compact (i.e., space saving) and is easy to use.

Further, since the color image forming apparatus 1 according to one embodiment of the present invention includes the bottom plate 34 in the holding frame 21 to receive the bottom of the fixing device 10 as an apparatus receiver when the fixing device 10 is attached to or detached from the holding frame 21, installation and removal of the fixing device 10 into and from the holding frame 21 can be easily executed as well.

Although the fixing unit 10 and the color image forming apparatus 1 are configured by the above-described structures, respectively, various structures other than the above-described embodiments may be employed as variants as demonstrated herein below. For example, although the bottom plate 34 of the holding frame 21, the multiple slits 31*a* and 32*a* of the left and right side plates 31 and 32 are horizontally formed perpendicular to the vertical direction, and accordingly the fixing device 10 is horizontally installed and removed into or from the holding frame 21 in the above-described various structures, the bottom plate of the holding frame and the slits of the left and right side plates may be upwardly inclined toward the front side in a removal direction as a modification.

In such a modification, when the fixing device is attached to the holding frame, it may be brought downward from an upper side to a lower side. By contrast, when the fixing device is removed from the holding frame, it may be almost lifted from the lower side to the upper side. Therefore, the fixing device may be readily attached to the holding frame.

Further, in a fixing device of yet another modification of one embodiment of the present invention, the bottom plate of the holding frame and respective slits of the left and right side plates may be downwardly inclined toward the front side in the removal direction. In such a modification, when the fixing device is attached to the frame, it may be almost lifted from a lower side to an upper side. By contrast, when the fixing device is removed from the holding frame, it may be almost brought down from the upper side to the lower side. Therefore, the fixing device may be readily separated from the holding frame.

Figure 17A:
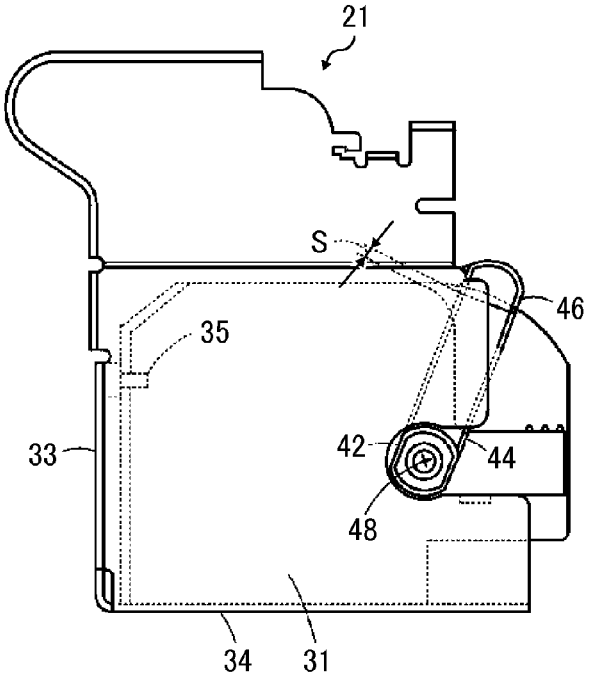
FIG. 17A is a side view illustrating a first modification of the fixing device in the locked position when the switching lever is pivoted upward to the locking position according to one embodiment of the present invention.
Figure 17B:
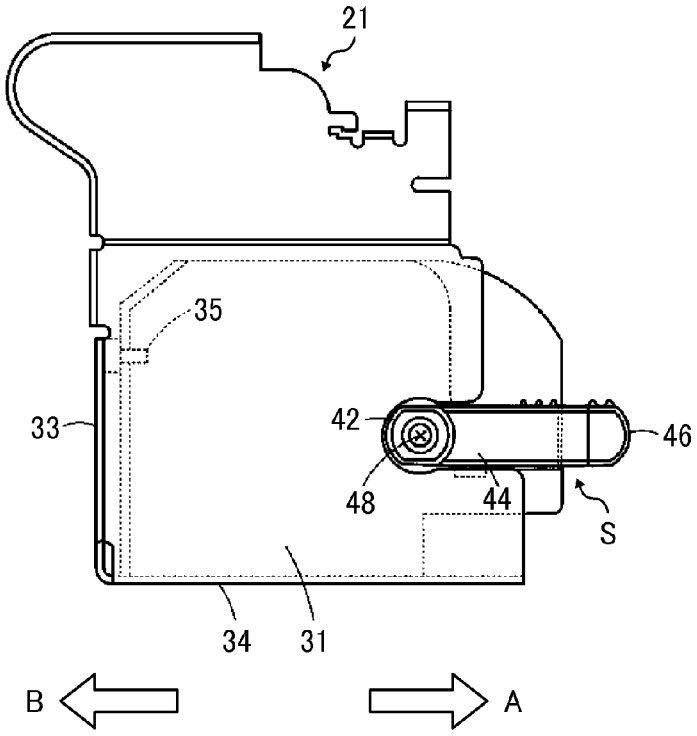
FIG. 17B is also a side view illustrating the first modification of the fixing device in the unlocked position when the switching lever is pivoted downward to the unlocking position according to one embodiment of the present invention.

Further, as shown in FIGS. 17A and 17B, even when the fixing device 10 is horizontally installed and removed into and from the holding frame 21, the locking member 42 may be positioned at a more front side in the direction as shown by arrow A as a modification than that in the above-described embodiment as illustrated in FIG. 13. Specifically, in the modification, as the switching lever 44 is pivoted downwardly, a clearance S shown by dotted lines between an arc-shaped surface of the housing 41 and the operating section 46 opposed thereto increasingly increase. More specifically, the supporting fixture 48 serving as a fulcrum for the switching lever 44 to pivot therearound is provided on the more front side than a curvature center of the arc-shaped surface of the housing 41 in the direction as shown by arrow A. Accordingly, since the gap S between the operating section 46 and the arc-shaped surface of the housing 41 opposed to it is relatively large, the fixing device 10 can be more easily held.

Figure 18:
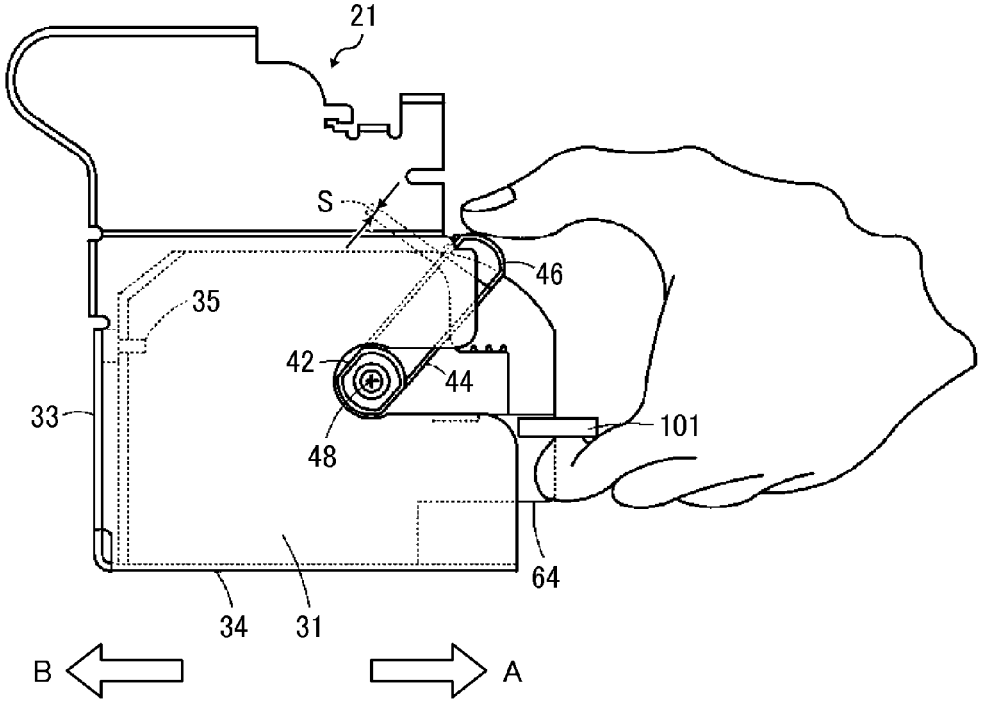
FIG. 18 is a side view illustrating an aspect of a second modification of the fixing device when an operator manipulates the operating section in the locking position according to one embodiment of the present invention.

Further, as shown in FIG. 18, projections 101 projecting from near the side ends of the housing 41 at the front side thereof in the direction as shown by arrow A may be included as yet another modification.

Figure 19:
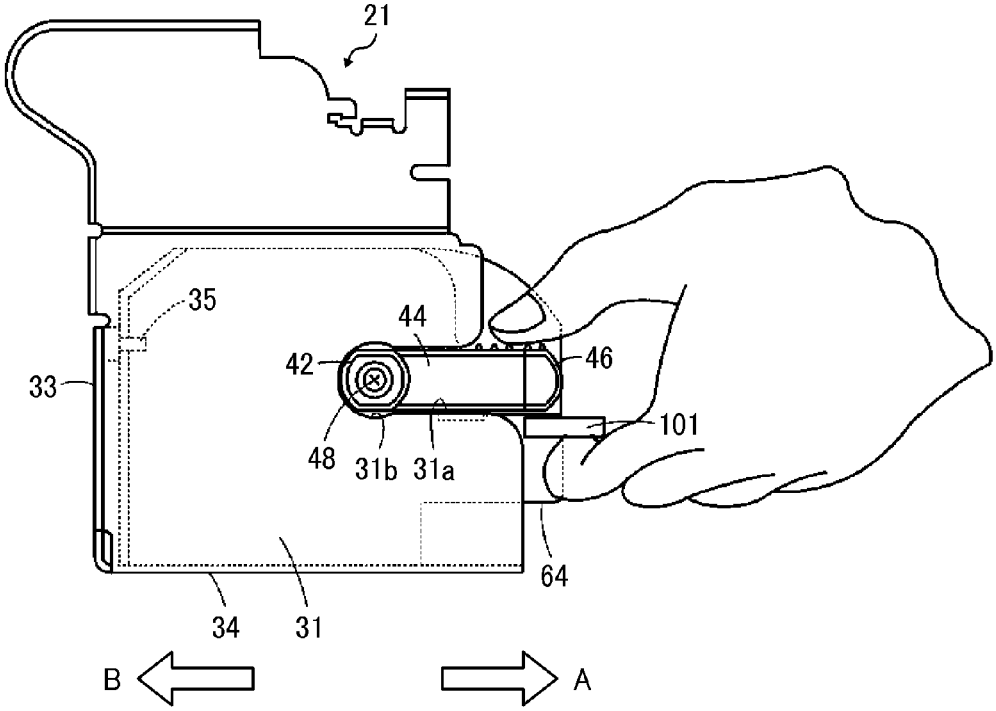
FIG. 19 is a cross-sectional view illustrating an aspect of the second modification of the fixing device when an operator manipulates the operating section in the unlocking position according to one modification of the present invention.

Specifically, in such a modification, operation to remove the fixing device 10 from the color image forming apparatus 1 is executed as described below only based on left hand operation. The front cover 1*a* of the color image forming apparatus 1 as shown in FIG. 1 is initially opened to expose the fixing device 10. Then, as shown in FIG. 18, the operator touches the operating section 46 of the switching lever 44 with his or her thumb, while touching a lower side surface of the projection 101 with his or her index finger. Subsequently, as shown in FIG. 19, the operator presses the switching lever 44 down with the thumb to render the operating section 46 to strike an upper surface of the projection 101. Accordingly, the locking member 44 rotates clockwise and turns sideways, so that the locking member 44 is unlocked from the slit 31*b*.

Figure 20:
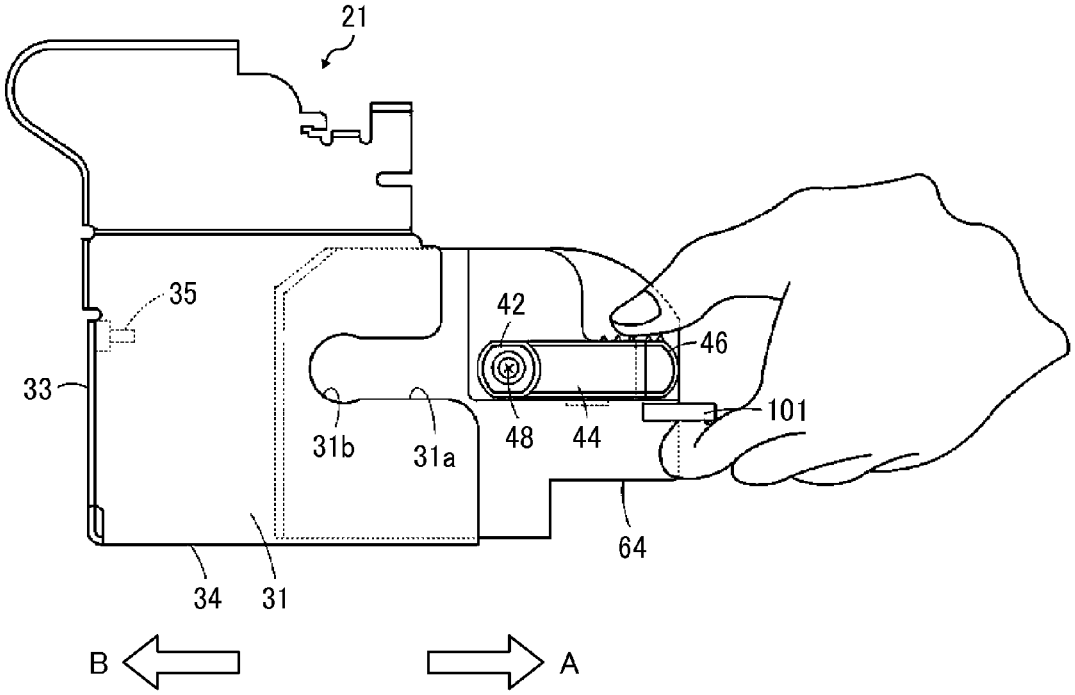
FIG. 20 is an enlarged perspective view partially illustrating an aspect of the second modification of the fixing device when the fixing device exits from the holding frame of the color image forming apparatus according to one modification of the present invention.
Figure 21:
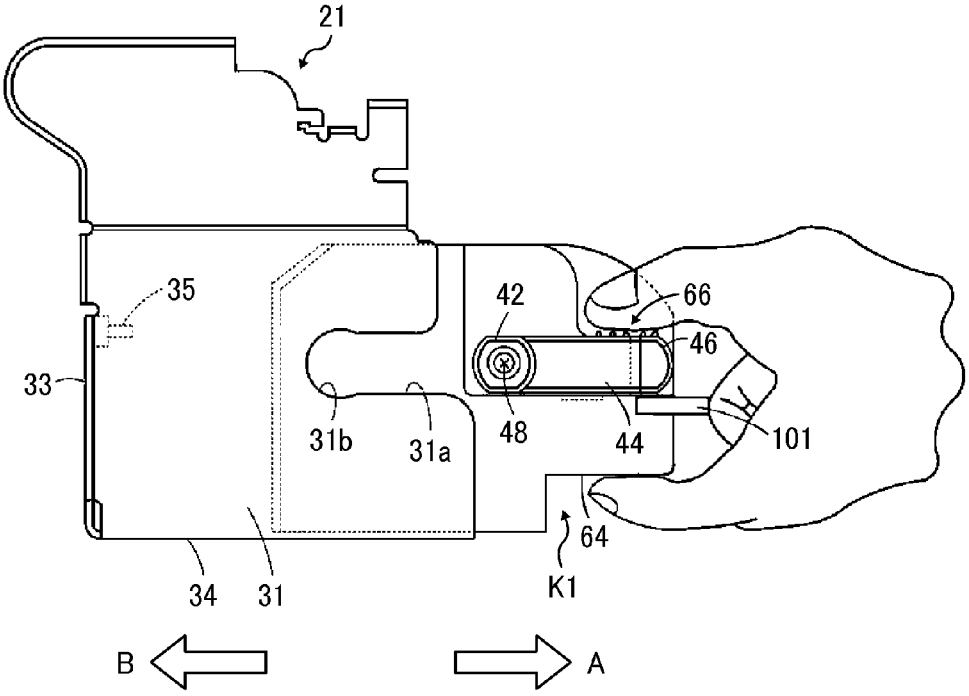
FIG. 21 is also an enlarged perspective view partially illustrating an aspect of the second modification of the fixing device when the fixing device exits from the holding frame of the color image forming apparatus according to one modification of the present invention.

Subsequently, as shown in FIG. 20, the fixing device 10 is drawn out to the front side while continuously pressing the switching lever 44 and the projection 101 with the thumb and the index finger. When the fixing device 10 is drawn out to the front side, the positioning pins 35 and 36 as shown in FIG. 3 are extracted from the housing 41, the locking member 44 can leave the slit 31*a*. Here, when the fixing device is lifted pressing both the switching lever 44 and the projection 101 with the thumb and the index finger, the thumb and the index finger receive load, because a center of gravity of the fixing device 10 exists in the inner side. Therefore, as shown in FIG. 21, the index finger is displaced from the projection 101 to the first handling section 64 when the fixing device 10 is supported on the bottom plate 34 of the holding frame 21.

Hence, by touching the first handling section 64 with the index finger, the fixing device 10 can be steadily held by the index finger and the thumb and is easily removed from the holding frame 21 as well. Specifically, when the fixing device is removed by holding the pivoting handle, a weight (i.e., a load) of the fixing device is not imposed on the handle and does not deform the handle unlike the above-described related art, thereby causing smooth removal of the fixing device. Here, according to this modification, operation to attach the fixing device 10 to the color image forming apparatus 1 is substantially the same as the above-described various operational examples, description thereof is omitted.

As described heretofore, according to one aspect of the present invention, a fixing device having fine usability detachably attachable to an image forming apparatus while minimizing a footprint of the image forming apparatus can be obtained. Specifically, a size of the handle to remove the fixing device from the image forming apparatus is relatively small, and a footprint of the fixing device as a whole can be readily reduced unlike the above-described related art. Further, a handle and a releasing lever to release a locking condition may not collectively serve as an operating section, and accordingly, an operator may not press the releasing lever to cancel the locking condition with one of his or her respective fingers of both hands and withdraw the handle and the releasing lever with the respective fingers at the same time, thereby smoothening operation unlike the above-described related art. Further, operation of drawing the fixing device by the operator by grasping both the handle and the releasing lever with the respective fingers toward the front side of the image forming apparatus is not unstable unlike the above-described related art. Further, the fixing device is not unwieldy unlike the above-described related art, because an operator holds the fixing device by grasping a holding section provided at a lower side in the housing and a relatively broader area of an operating section oppositely arranged to the holding section in the upper side therein. Further, even when the operating section is attached to a switching lever that switches a locking condition to an unlocking condition, vice-versa, the operating section itself, the switching lever, and the other similar components are not damaged unlike the above-described related art, because the switching lever is rarely displaced and does not lack stability when the operator grasps the operating section.

That is, according to one aspect of the present invention, a fixing device includes a housing detachably attachable to a body of an image forming apparatus; a fixing unit mounted on the housing to heat and fix an unfixed toner image onto a recording medium; and a locking mechanism to lock and unlock the housing on the body of an image forming apparatus by switching its own position between a locking position and an unlocking position. Further, an operating member is provided in the housing to operate the locking mechanism. A first handling member is also provided at a lower side in the housing to be handled when the housing is either attached to or detached from the body of an image forming apparatus. A second handling member is provided at an upper side in the housing in the vicinity of the operating member to be handled when the housing is either attached to or detached from the body of an image forming apparatus. Further, the operating member and the first and second handling members collectively constitute a handling unit to be simultaneously handled when the housing is either detached from or attached to the body of the image forming apparatus.

According to another aspect of the present invention, a fixing device having fine usability more safely detachably attachable to the image forming apparatus while minimizing a footprint of the image forming apparatus can be obtained, because the operating member switches a position of the locking mechanism to the unlocking position while approaching the second handling member.

According to yet another aspect of the present invention, a fixing device having fine usability more safely detachably attachable to the image forming apparatus while minimizing a footprint of the image forming apparatus can be obtained, because the locking mechanism is a switching lever integrally connected to the operating member at its front side tip.

According to yet another aspect of the present invention, a fixing device having fine usability more safely detachably attachable to the image forming apparatus while minimizing a footprint of the image forming apparatus can be obtained, because the locking mechanism includes a pressing mechanism to press and bias the switching lever toward the locking position.

According to yet another aspect of the present invention, a fixing device having fine usability more safely detachably attachable to the image forming apparatus while minimizing a footprint of the image forming apparatus can be obtained, because the operating section includes a sufficient area to grasp, withdrawal of the fixing device to a front side of the image forming apparatus grasping a relatively wider area is not difficult unlike the above-described related art. More specifically, a space is formed below the lower side of the first handling member to readily insert a finger.

According to yet another aspect of the present invention, a fixing device having fine usability more safely detachably attachable to the image forming apparatus while minimizing a footprint of the image forming apparatus can be obtained, because an operating member striker is provided in the housing to strike the operating member when the locking mechanism is switched to the unlocking position.

According to yet another aspect of the present invention, a fixing device having fine usability more safely detachably attachable to the image forming apparatus while minimizing a footprint of the image forming apparatus can be obtained, because the handling unit is provided at a lateral end of a conveyance path for the recording medium.

According to yet another aspect of the present invention, a fixing device having fine usability more safely detachably attachable to the image forming apparatus while minimizing a footprint of the image forming apparatus can be obtained, because even when it is pivoted to unlock the fixing device in a body of the image forming apparatus, the handle does not necessarily protrude greatly from a lateral end of the fixing device, and accordingly a footprint of the fixing device is readily reduced unlike the above-described related art. That is, the handling unit is provided proximally in a direction in which the fixing device is drawn out from the body of the image forming apparatus.

According to another aspect of the present invention, an image forming apparatus having usability capable of minimizing a footprint of the image forming apparatus can be obtained, because the image forming apparatus employs the above-described fixing device having fine usability more safely detachably attachable to the image forming apparatus while minimizing the footprint of the image forming apparatus.

According to yet another aspect of the present invention, a fixing device that heats and fixes an unfixed toner image onto a recording medium can be safely detachably attachable from and to an image forming apparatus with fine usability minimizing a footprint of the image forming apparatus. That is, a method of accommodating and removing the fixing device to and from the image forming apparatus comprises the steps of: grasping a first handling member with a first finger; grasping an operating member with a second finger other than the first finger; pivoting a locking mechanism with the second finger via the operating member from locking to unlocking positions; grasping the operating member and the second handling member at the same time with the second finger when the locking mechanism is pivoted and the operating member approaches the second handling member; and detaching the housing from the body of the image forming apparatus while grasping both the first and second handling members with the first and second fingers simultaneously.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various aspects and can be appropriately changed.

What is claimed is:

1. A fixing device comprising:

a housing detachably attachable to a body of an image forming apparatus;

a fixing unit mounted on the housing to heat and fix an unfixed toner image onto a recording medium;

a locking mechanism to lock and unlock the housing on the body of an image forming apparatus by switching its own position between a locking position and an unlocking position;

an operating member provided in the housing to operate the locking mechanism;

a first handling member provided at a lower side in the housing to be handled when the housing is either attached to or detached from the body of an image forming apparatus; and a second handling member provided at an upper side in the housing at approximately a same plane as a longitudinal length of the operating member when the operating member switches a position of the locking mechanism to the unlocked position to be handled when the housing is either attached to or detached from the body of an image forming apparatus, the operating member and the first and second handling members collectively constituting a handling unit to be simultaneously handled when the housing is either detached from or attached to the body of the image forming apparatus.

2. The fixing device as claimed in claim 1, wherein the operating member switches a position of the locking mechanism to the unlocking position while approaching the second handling member.

3. The fixing device as claimed in claim 1, wherein the locking mechanism is a switching lever integrally connected to the operating member at its front side tip.

4. The fixing device as claimed in claim 1, wherein the locking mechanism includes a pressing mechanism to press and bias the switching lever toward the locking position.

5. The fixing device as claimed in claim 1, further comprising a space formed below the lower side of the first handling member.

6. The fixing device as claimed in claim 1, further comprising an operating member striker provided in the housing to strike the operating member when the locking mechanism is switched to the unlocking position.

7. The fixing device as claimed in claim 1, wherein the handling unit is provided at a lateral end of a conveyance path for the recording medium.

8. The fixing device as claimed in claim 1, wherein the handling unit is provided proximally in a direction in which the fixing device is drawn out from the body of the image forming apparatus.

9. An image forming apparatus including a fixing device to provide heat and fix an unfixed toner image onto a recording medium, the fixing device comprising:

a housing detachably attached to a body of an image forming apparatus; a fixing unit mounted on the housing to provide heat and fix an unfixed toner image onto a recording medium;

a locking mechanism to lock and unlock the housing in the body of an image forming apparatus by switching its own position between a locking position and an unlocking position;

an operating member provided in the housing to operate the locking mechanism;

a first handling member provided at a lower side in the housing to be handled when the housing is either attached to or detached from the body of an image forming apparatus; and a second handling member provided at an upper side in the housing at approximately a same plane as a longitudinal length of the operating mechanism when the operating member switches a position of the locking mechanism to the unlocked position to be handled when the housing is either attached to or detached from the body of an image forming apparatus, the operating member and the first and second handling members collectively constituting a handling unit to be simultaneously handled when the housing is either detached from or attached to the body of the image forming apparatus.

10. The image forming apparatus as claimed in claim 9, wherein the operating member switches a position of the locking mechanism to the unlocking position while approaching the second handling member.

11. The image forming apparatus as claimed in claim 9, wherein the locking mechanism is a switching lever integrally connected to the operating member at its front side tip.

12. The image forming apparatus as claimed in claim 9, wherein the locking mechanism includes a pressing mechanism to press and bias the switching lever toward the locking position.

13. The image forming apparatus as claimed in claim 9, further comprising a space formed below the lower side of the first handling member.

14. The image forming apparatus as claimed in claim 9, further comprising an operating member striker provided in the housing to strike the operating member when the locking mechanism is switched to the unlocking position.

15. The image forming apparatus as claimed in claim 9, wherein the handling unit is provided at a lateral end of a conveyance path for the recording medium.

16. The image forming apparatus as claimed in claim 9, wherein the handling unit is provided proximally in a direction in which the fixing device is drawn out from the body of the image forming apparatus.

17. The image forming apparatus as claimed in claim 9, further comprising a supporting unit provided in the body to support the bottom of the fixing device when the fixing device is attached to and detached from the body.

18. A method of accommodating and removing a fixing device that heats and fixes an unfixed toner image onto a recording medium to and from an image forming apparatus, the fixing device comprising: a housing detachably attached to a body of an image forming apparatus; a locking mechanism to lock and unlock the housing in the body of an image forming apparatus by switching its own position between a locking position and an unlocking position; an operating member provided in the housing to operate the locking mechanism; a first handling member provided at a lower side in the housing to be handled when the housing is either attached to or detached from the body of an image forming apparatus; and a second handling member provided at an upper side in the housing at approximately a same plane as a longitudinal lenth of the operating mechanism when the operating member switches a position of the locking mechanism to the unlocked position to be handled when the housing is either attached to or detached from the body of an image forming apparatus, the operating member and the first and second handling members collectively constituting a handling unit to be simultaneously handled when the housing is either detached from or attached to the body of the image forming apparatus, the method comprising the steps of:

grasping the first handling member with a first finger;

grasping the operating member with a second finger other than the first finger;

pivoting the locking mechanism with the second finger via the operating member from locking to unlocking positions;

grasping the operating member and the second handling member at the same time with the second finger when the locking mechanism is pivoted and the operating member approaches the second handling member; and detaching the housing from the body of the image forming apparatus while grasping both the first and second handling members with the first and second fingers simultaneously.

19. The method as claimed in claim 18, further comprising an operating member striker provided in the housing to strike the operating member when the locking mechanism is switched to the unlocking position, wherein the operating member switches a position of the locking mechanism to the unlocking position while approaching the second handling member, wherein the locking mechanism is a switching lever integrally connected to the operating member at its front side tip, wherein the locking mechanism includes a pressing mechanism to press and bias the switching lever toward the locking position, wherein a space is formed below the lower side of the first handling member, wherein the handling unit is provided at a lateral end of a conveyance path for a recording medium, wherein the handling unit is provided proximally in a direction in which the fixing device is drawn out from the body of an image forming apparatus.

20. The method s as claimed in claim 18, further comprising the step of supporting the bottom of the fixing device with a supporting member when the fixing device is either attached or detached from the body of an image forming apparatus.

* * * * *